US011434762B2

(12) United States Patent
Jordaan et al.

(10) Patent No.: US 11,434,762 B2
(45) Date of Patent: Sep. 6, 2022

(54) MOBILE UNDERGROUND TUNNEL BORER ARRANGEMENT

(71) Applicant: DRILLING TECHNICAL SERVICES (PTY) LTD, Gauteng (ZA)

(72) Inventors: Barend Jacobus Jordaan, Gauteng (ZA); Gerhard Pretorius, Gauteng (ZA); Johannes Nicolaas Jacobus Calitz, Gauteng (ZA); Williem Hermanus Roothman, Gauteng (ZA)

(73) Assignee: DRILLING TECHNICAL SERVICES (PTY) LTD, Gauteng (ZA)

( * ) Notice: Subject to any disclaimer, the term of this patent is extended or adjusted under 35 U.S.C. 154(b) by 67 days.

(21) Appl. No.: 16/635,852

(22) PCT Filed: Jul. 31, 2018

(86) PCT No.: PCT/IB2018/055713

§ 371 (c)(1),
(2) Date: Jan. 31, 2020

(87) PCT Pub. No.: WO2019/025959

PCT Pub. Date: Feb. 7, 2019

(65) Prior Publication Data

US 2020/0370434 A1 Nov. 26, 2020

(30) Foreign Application Priority Data

| | | |
|---|---|---|
| Jul. 31, 2017 | (ZA) | 2017/02323 |
| Oct. 19, 2017 | (ZA) | 2017/07079 |
| Feb. 5, 2018 | (ZA) | 2018/00727 |

(51) Int. Cl.
*E21D 9/11* (2006.01)
*E21D 9/06* (2006.01)
(Continued)

(52) U.S. Cl.
CPC ..... *E21D 9/112* (2013.01); *E21D 9/0692* (2013.01); *E21D 9/1093* (2013.01); *E21D 9/12* (2013.01); *E21D 20/003* (2013.01)

(58) Field of Classification Search
CPC ..... E21D 9/112; E21D 9/0692; E21D 9/1093; E21D 9/12; E21D 20/003; E21C 25/16; E21C 25/18; E21C 29/02; E21C 35/20
See application file for complete search history.

(56) References Cited

U.S. PATENT DOCUMENTS 2,766,978 A * 10/1956 Robbins ..... E21D 9/112 299/60
4,390,211 A * 6/1983 Thompson ..... E21C 27/24 299/57

(Continued)

FOREIGN PATENT DOCUMENTS

EP 0 812 979 A1 12/1997
GB 2065747 A * 7/1981

OTHER PUBLICATIONS

Work Method Installation of TBM, Ryan Maulana, pp. 5 (Year: 2015).*

(Continued)

*Primary Examiner* — Sunil Singh
(74) *Attorney, Agent, or Firm* — Ladas & Parry LLP

(57) ABSTRACT

A mobile tunnel boring unit is disclosed, comprising a support body driven by first drive means, the first drive means including a pair of spaced apart crawler tracks in contact with the tunnel floor and related track driving means to move the tracks. A cutter head drive means is located at an operatively front end of the boring unit, to which a rotatable cutter head can be fitted and rotatingly driven, in use, the cutter head comprising a full face cutter head fitted with cutters to bore a tunnel face. The cutter head is arranged to allow cuttings to pass through the cutter head for discharge into a muck hopper and onto a first conveyor arrangement, the cutter head drive means and a rear portion of the cutter head defining aligned central apertures to accommo- (Continued)

date the muck hopper and a front part of the first conveyor arrangement. A telescopic shield arrangement is provided to shield the boring unit.

19 Claims, 42 Drawing Sheets

(51) Int. Cl.

| | |
|---|---|
| ***E21D 9/10*** | (2006.01) |
| ***E21D 9/12*** | (2006.01) |
| ***E21D 20/00*** | (2006.01) |

(56) References Cited

U.S. PATENT DOCUMENTS

| | | | | |
|---|---|---|---|---|
| 5,340,199 | A * | 8/1994 | Piefenbrink | E21D 9/1006 299/10 |
| 5,527,099 | A | 6/1996 | Fikse | |
| 6,428,109 | B1 * | 8/2002 | Lerchbaum | E21D 9/1026 299/75 |
| 6,431,653 | B1 * | 8/2002 | Kleuters | E21D 9/0621 299/31 |
| 2010/0148566 | A1 | 6/2010 | Home et al. | |
| 2012/0032494 | A1 | 2/2012 | Veldman et al. | |

OTHER PUBLICATIONS

International Search Report (ISR) and Written Opinion (WO) dated Oct. 29, 2018 for Application No. PCT/IB2018/055713.

* cited by examiner

MOBILE UNDERGROUND TUNNEL BORER ARRANGEMENT

RELATED APPLICATION

This application is an application under 35 U.S.C. 371 of International Application No. PCT/IB2018/055713 filed on Jul. 31, 2018, the entire contents of which are incorporated herein by reference.

FIELD OF INVENTION

THIS INVENTION relates to a mobile underground tunnel borer arrangement.

BACKGROUND OF INVENTION

A tunnel boring machine (TBM) is a machine used to excavate tunnels with a circular cross section through a variety of soil and rock. Tunnel diameters can range from 1 meter (done with micro-TBMs) up to around 19 meters. Tunnels of less than 1 meter or so in diameter are typically done using horizontal directional drilling rather than TBMs.

Tunnel boring machines are used as an alternative to drilling and blasting methods in rock, and conventional "hand mining" in soil. TBMs have the advantages of limiting the disturbance to the surrounding ground and producing a smooth tunnel wall. This significantly reduces the cost of lining the tunnel and makes them suitable to use in heavily urbanized areas. The major disadvantage is cost, since TBMs are expensive to construct and can be difficult to transport. The longer the tunnel, the less the relative cost of tunnel boring machines versus drill and blast methods. This is because tunneling with TBMs is more efficient and results in shortened completion times (and is thus relatively safer).

Modern TBMs typically consist of the rotating cutting wheel, called a cutter head, followed by a main bearing, a thrust system and a trailing support arrangement. The type of machine used depends on the particular geology of the project, the amount of ground water present and other factors. In hard rock, which is typically where TBMs are most commonly used, either shielded or open-type TBMs can be used. In addition, TBMs can be used in either a 'wet-cutting' application, in which mist is sprayed onto the cutter head, or in a 'dry-cutting' application, in which no mist is spayed. In all cases, however, TBMs excavate hard rock using disc cutters mounted on the cutter head. The disc cutters create compressive stress fractures in the rock, causing it to chip away from the rock in front of the machine, called the tunnel face. The excavated rock, known as muck, is transferred through openings in the cutter head to a belt conveyor, where it runs through the machine to a system of conveyors or muck cars for removal from the tunnel.

Open-type TBMs have no shield, and are thus unsupported, which is not ideal from a safety point of view. To advance, the machine uses a gripper system that pushes against the side walls of the tunnel. The machine will then push forward off the grippers gaining thrust. At the end of a stroke, the rear legs of the machine are lowered, the grippers and thrust cylinders are retracted. The retraction of the thrust cylinders repositions the gripper assembly for the next boring cycle. The grippers are extended, the rear legs lifted, and boring begins again. The open-type TBM typically uses ground support methods, such as ring beams, rock bolts, shotcrete, steel straps, ring steel and wire mesh.

It is thus an aim of the present invention to provide a mobile underground tunnel borer arrangement that addresses most of the inherent problems or disadvantages associated with conventional TBMs, whilst still retaining and utilising the proven advantages associated with current TBMs.

SUMMARY OF THE INVENTION

1st Version

According to the invention, there is provided a mobile underground tunnel borer arrangement comprising:

- a mobile tunnel boring unit comprising first drive means to drive the mobile tunnel boring unit, a gripper arrangement to facilitate boring by providing grip and thrust, and a rotatable cutter head fitted with cutters to bore the tunnel face; and
- at least one backup unit trailing behind the mobile tunnel boring unit, each backup unit comprising second drive means to drive the backup unit and a support frame on top of the second drive means.

In a first version of the borer arrangement, the gripper arrangement includes a front gripper assembly and a rear gripper assembly, each gripper assembly including a support body and four movable gripper elements that can be extended and retracted, using first actuators, relative to the support body. In the extended position, the gripper elements grip against the tunnel wall and in the retracted position, the first drive means can be operated to move the mobile tunnel boring unit.

In an embodiment, the gripper elements take the form of gripper pads that are fitted on spherical joints. In an embodiment, the four movable gripper elements extend at 45 degree angles around the support body, so as to define an 'X'. In an embodiment, the front and rear gripper assemblies are fitted to either end of a torque shaft housing with second actuators being arranged to extend and retract the support body of the front gripper assembly and the cutter head relative to the torque shaft housing.

In an embodiment, the cutter head includes a central engaging face with a plurality of cutter segments extending at an angle away from the central engaging face, so as to define a tapered, self-centring arrangement. In one version, the cutter segments can be removed from the cutter head; in another version, the cutter segments can be movably collapsible relative to the cutter head. In an embodiment, a dust shield is provided between the front gripper assembly and the cutter head, with a conveyor arrangement extending from the dust shield to enable the muck and cuttings to be transported to a tunnelling truck for subsequent disposal. The conveyor arrangement comprises a first conveyer on top of the mobile tunnel boring unit, to receive the cuttings via a chute provided on the dust shield, and a second conveyor on top of a first backup unit to continue conveying the cuttings towards the truck. In an embodiment, the borer arrangement includes a support drill and related platform, which is disconnected from the mobile tunnel boring unit.

2nd Version

In a second, preferred version of the borer arrangement, the mobile tunnel boring unit is fitted with a telescopic shield arrangement comprising a front shield proximate the front of the mobile tunnel boring unit, from which the cutter head protrudes, and a rear shield that surrounds at least an upper portion of the mobile tunnel boring unit.

1. Main Drive

The front shield accommodates cutter head drive means (mounted onto the cutter head) to rotatingly drive the cutter head, the cutter head drive means typically comprising hydraulic drive motors that drive a ring gear which is stabilised by a thrust bearing. A special sealing arrangement is provided to keep dust outside so as to not penetrate the cutter head drive means. The cutter head drive means was shaped specifically to aid fast assembly of the front shield in the correct sequence. A special quick attachment method is used to aid fast assembly/connection between the cutter head drive means to the cutter head when the cutter head has been assembled in the cutting face. The cutter head drive was designed with an open hollow centre to allow the main conveyor to collect dust inside the cutter head. The same opening allows access to the cutter head for maintenance 2. Thrust Arrangement In an embodiment, an actuating arrangement, comprising a plurality of hydraulic thrust cylinders, extends between the cutter head drive means and a support arrangement on a rear end of the mobile tunnel boring unit, the actuating arrangement being arranged to telescopingly move the front shield relative to the support arrangement on a rear end of the mobile tunnel boring unit, and thus relative to the rear shield which is fixed to the rear end of the mobile tunnel boring unit.

The thrust cylinder arrangement provides a flexible link between the cutter head drive and the support arrangement, that allows for correction of the support arrangement after rotational slippage. The thrust cylinders, typically four pairs of thrust cylinders, extend slightly inwardly from the support arrangement on the rear end of the mobile tunnel boring unit towards the cutter head drive means. This enables the mobile tunnel boring unit arrangement to be steered in all directions i.e. up, down, left and right, thus enabling cutaways, cross-cuts, declines, inclines and even spiral shafts to be bored. Connection of the thrust cylinders are via spherical ball joints on either end to accommodate free movement. The thrust cylinders are equipped with position sensors, enabling the system to establish the position of the cutter head relative to the support arrangement 3. Grippers In an embodiment, the gripper arrangement includes a front gripper stabilizer assembly, fitted to, so as to extend from, the front shield, and a rear gripper assembly, fitted to, so as to extend from, the support arrangement on a rear end of the mobile tunnel boring unit. Each gripper assembly includes a support body and two movable, curved gripper elements that can be extended and retracted, using first actuators, relative to their respective support body. A stabilizer gripper assembly extends at 45° and the rear gripper assembly extends at 180°. In the extended position, the curved gripper elements grip against the tunnel wall, and in the retracted position, the mobile tunnel boring unit can be pulled forwards. In an embodiment, the gripper elements take the form of curved gripper pads that are fitted on pin type spherical joints to accommodate free movement.

4. Cutter Head

In an embodiment, the cutter head takes the form of a full face cutter head fitted with disc cutters, the cutter head defining scoops and channels to allow cuttings and muck to pass automatically through the cutter head for discharge into a muck hopper and collection onto a first conveyor arrangement located immediately behind the cutter head. The first conveyor arrangement extends through the mobile tunnel boring unit for subsequent offloading onto a first backup unit.

In an embodiment, the cutter head is detachably secured to the mobile tunnel boring unit using a quick attachment method, which improves the efficiency of the boring cycle. The centre segment has a tapered profile to accommodate accurate segment attachment. All cutters are of the back-loading type, to accommodate efficient maintenance. In addition, the cutter head comprises a plurality of segments that can be pre-installed with the front shield. The cutter head may also have varying sizes, as required in use; the envisaged diameter range is between 4.5 metres and 5.5 metres. This is achieved by having a common centre segment onto which the various segments for the 4.5 and 5.5 configurations are bolted.

5. Conveyor

The first conveyor arrangement extends through the mobile tunnel boring unit for subsequent offloading onto a first backup unit. The first conveyor is retractable away from the cutter head drive to allow access for cutter change and maintenance. All conveyors are designed with variable geometry, to enable the conveyors to be compacted to assist manoeuvrability during transportation. All conveyors have a modular design to enable common parts inventory to ease spares and maintenance requirements. In an embodiment, the first, second and third conveyor arrangements are all collapsible, so as to improve and facilitate manoeuvrability.

6. Support Drill and Probe Drill

In an embodiment, a support drill rotation ring and associated ring drive means to rotate the ring are fitted proximate the rear end of the mobile tunnel boring unit, typically behind the support arrangement. The support drill rotation ring carries two spaced apart drills, to facilitate the fitting of rock bolt supports to the surrounding wall. The drills are able to rotate on their own axes to allow a V-configuration for varying support bolt drilling arrangements. The drills are equipped with sliders so they can be stabilised against the tunnel wall. The shields house the probe drill near the cutter head. The probe drill position and orientation can be manually adjusted to allow cover drilling in three directions through the cutter head. In turn, the cutter head is equipped with three openings through which the probe drill rods can advance 7. Shields In an embodiment, the rear shield includes a plurality of fingers that define gaps through which the drills can extend and drill. These fingers are hydraulically actuated to provide adjustment during transport and also support to the tunnel wall during support drilling, to protect the support drill operators. Shields are designed to be modular, to ease transport by limiting size and weight. Shield assembly is efficient with a shield interface, resulting in quick alignment and easy access for fasteners.

The bottom/belly shield segment stabilises the mobile tunnel borer, in cooperation with the gripper pads, by skidding on the tunnel invert at all times. The belly shield is equipped with replaceable wear plates to extend its operating lifespan. Shields operate telescopically relative to each other, assisting in machine mobility and agility whilst boring direction changes and curves.

8. Crawler Tracks

In an embodiment, the first drive means for driving the mobile tunnel boring unit includes a pair of spaced apart tracks in contact with the tunnel floor, and related track driving means to move the tracks, and thus the mobile tunnel boring unit. In an embodiment, the tracks are mounted to the bottom of the mobile tunnel boring unit and can hydraulically be pivoted/adjusted, to better accommodate the round shape of the bored tunnel. In addition, the tracks can be moved with six degrees of freedom relative to the boring unit, to accommodate varying diameters of the boring unit and perfect alignment when assembling the mobile tunnel borer to the cutter head. The crawler tracks are also equipped with stabilising cylinders that are actuated to lift the mobile tunnel borer from its tracks when a pivot adjustment is made. The crawler tracks are powered by a diesel powered hydraulic motivator, which is latched to the back of the mobile tunnel boring unit. The crawler track is operated by a handheld remote control, by one operator in close proximity to the mobile tunnel borer.

9. 1st Back-Up Unit

In an embodiment, the first backup unit is fitted with a second conveyor arrangement to receive the cuttings and muck from the first conveyor arrangement on the mobile tunnel boring unit towards a second backup unit. In an embodiment, the first backup unit is fitted with the main hydraulic power pack and also the electric panel that is equipped with the PLC system. The first back-up unit is also fitted with the scrubber unit to assist with dust suppression.

10. 2nd Back-Up Unit

In an embodiment, the third backup unit is fitted with a third conveyor arrangement to receive the cuttings and muck from the second conveyor arrangement on the first backup unit towards a truck. In an embodiment, the second backup unit is fitted with the cooling water circulation pumping system. The second back-up unit is also fitted with the main incoming transformer substation and also the dust extraction fan unit. Cable and hose reels are fitted as well to allow continuous operation for 300 meters.

BRIEF DESCRIPTION OF DRAWINGS

The invention will now be further described, by way of example, with reference to the accompanying diagrammatic drawings. In the drawings.

DETAILED DESCRIPTION OF EXAMPLE EMBODIMENTS

Figure 1:
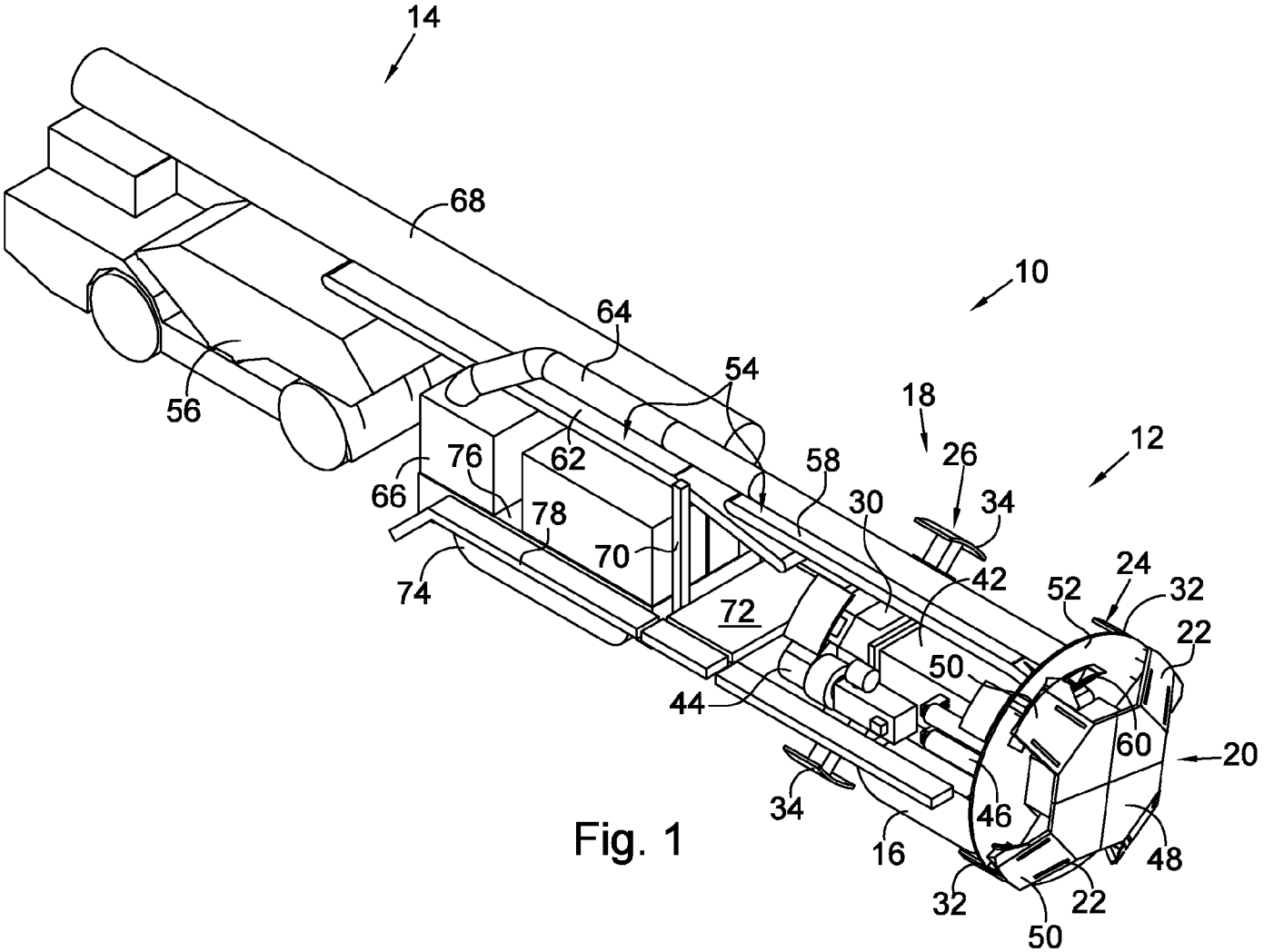
FIG. 1 shows a first top perspective view of a mobile underground tunnel borer arrangement, according to a first embodiment of the present invention.
Figure 2:
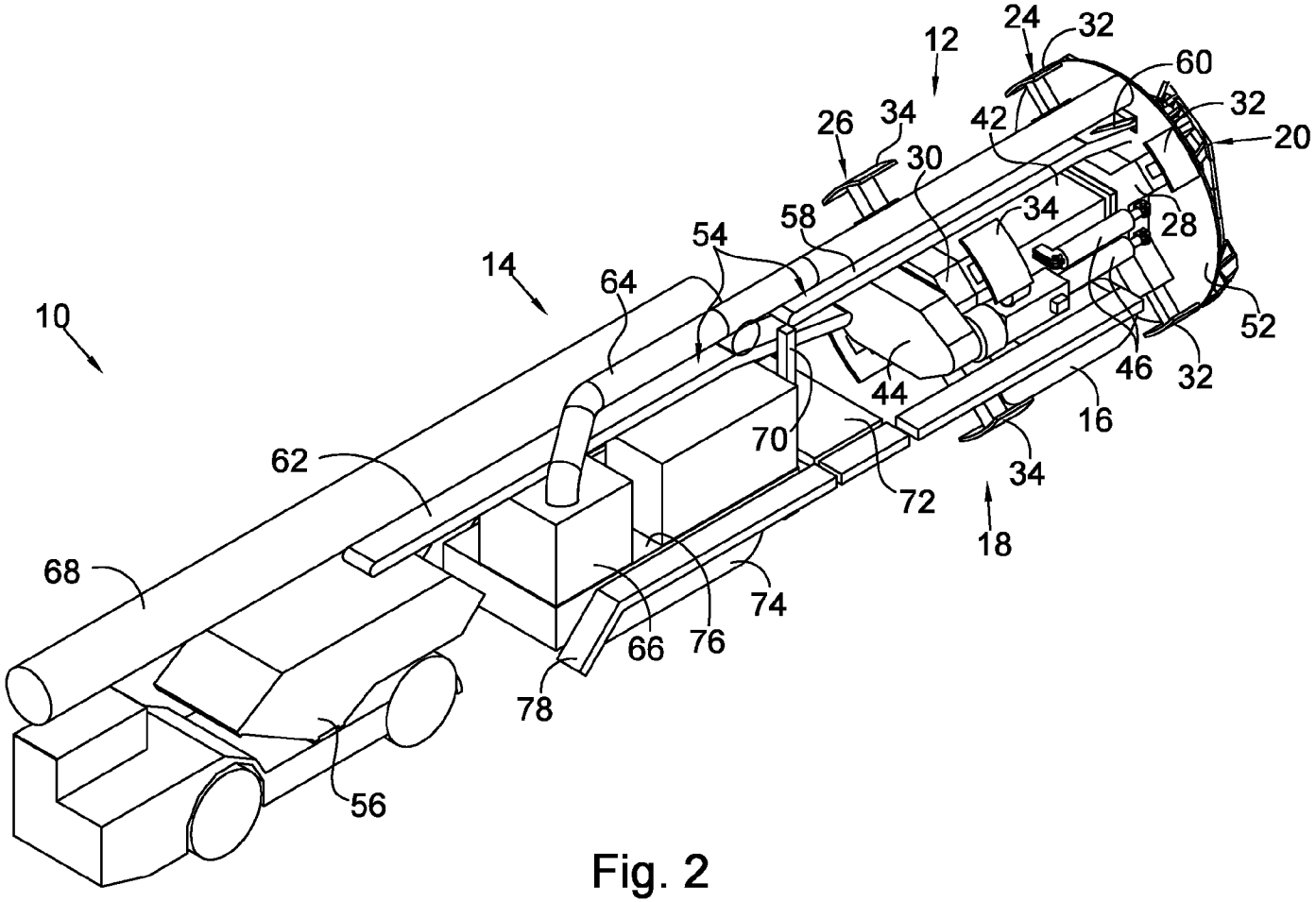
FIG. 2 shows a second top perspective view of the mobile underground tunnel borer arrangement shown in FIG. 1.
Figure 3:
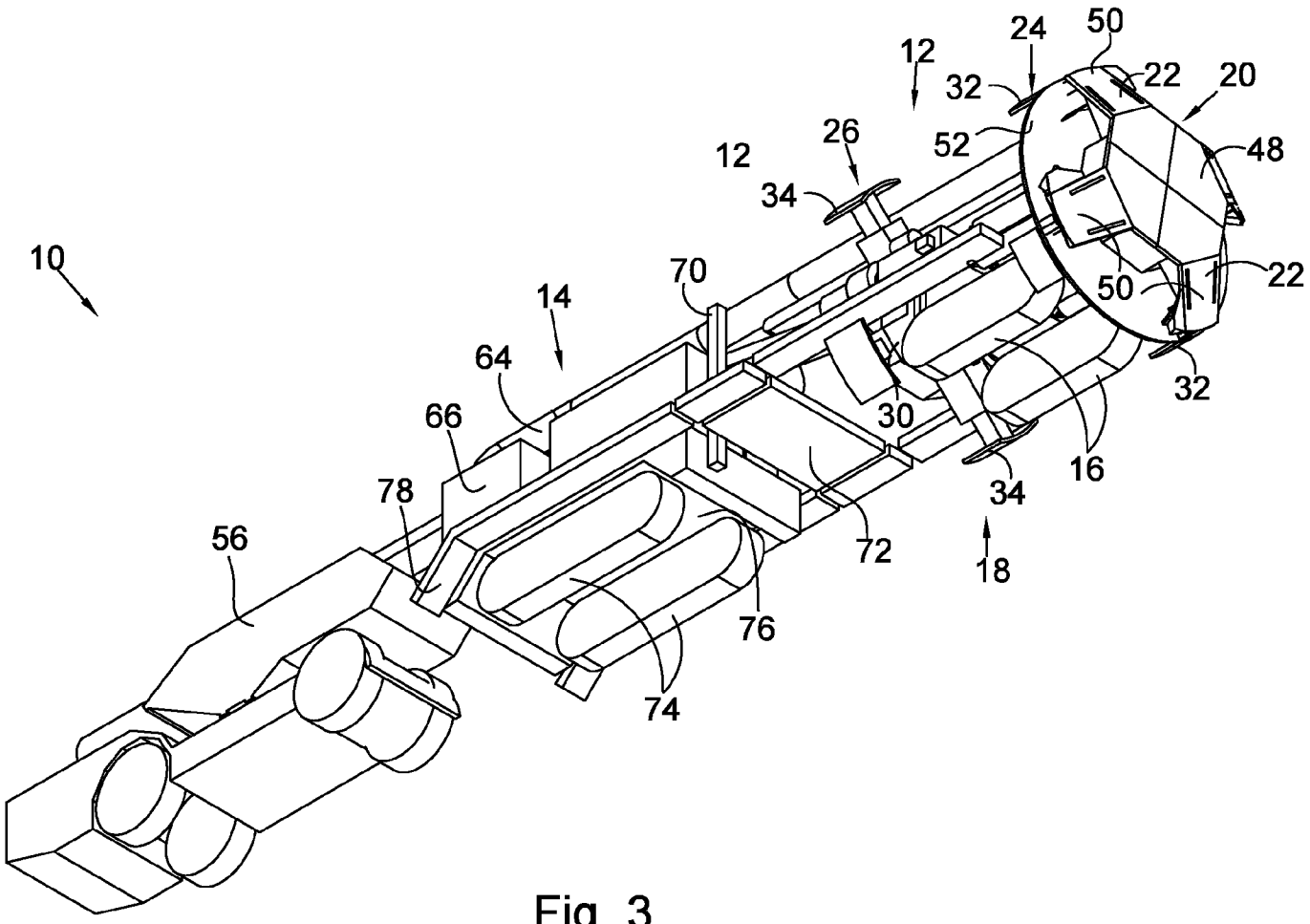
FIG. 3 shows a bottom perspective view of the mobile underground tunnel borer arrangement.
Figure 4:
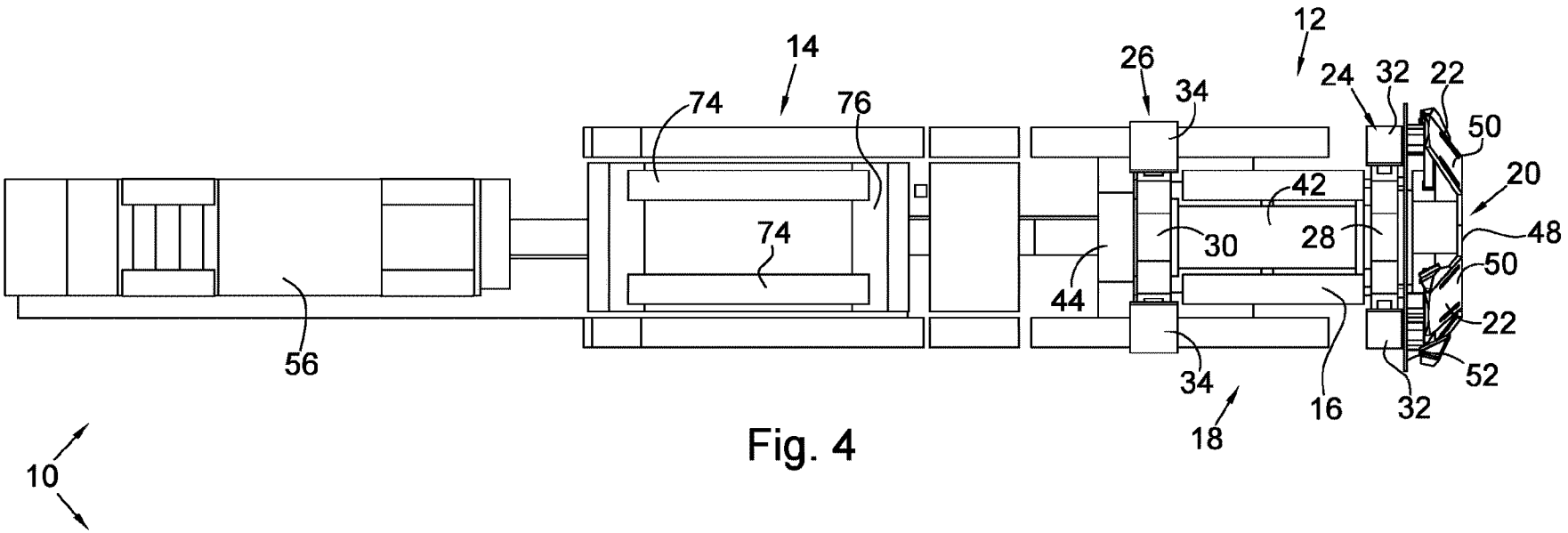
FIG. 4 shows a bottom view of the mobile underground tunnel borer arrangement.
Figure 5:
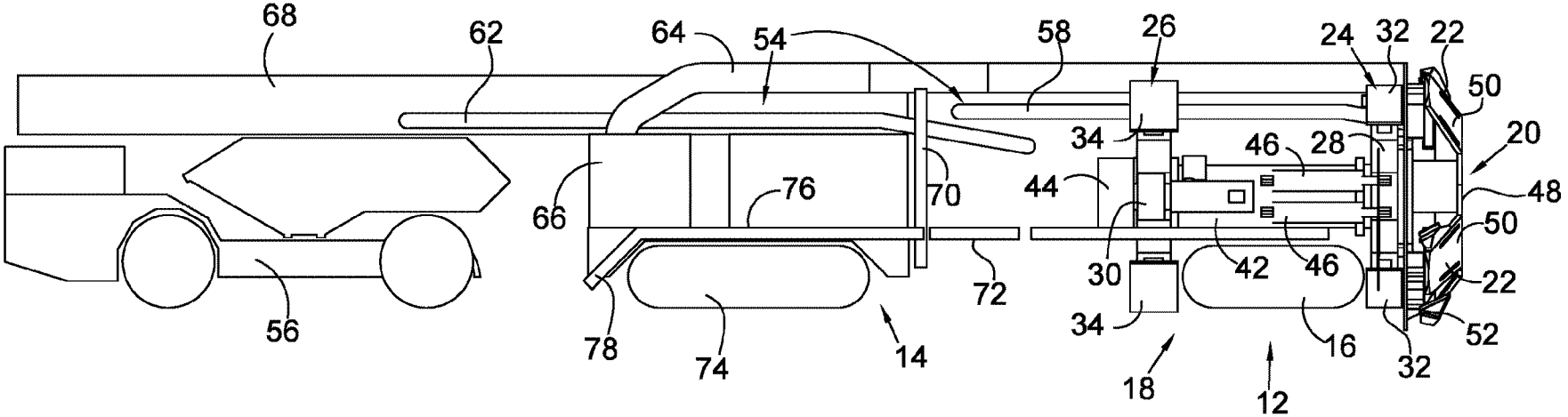
FIG. 5 shows a side view of the mobile underground tunnel borer arrangement.

The following description of the invention is provided as an enabling teaching of the invention. Those skilled in the relevant art will recognise that many changes can be made to the embodiment described, while still attaining the beneficial results of the present invention. It will also be apparent that some of the desired benefits of the present invention can be attained by selecting some of the features of the present invention without utilising other features. Accordingly, those skilled in the art will recognise that modifications and adaptations to the present invention are possible and can even be desirable in certain circumstances, and are a part of the present invention. Thus, the following description is provided as illustrative of the principles of the present invention and not a limitation thereof.

Referring to FIGS. 1 to 5 of the drawings, a mobile underground tunnel borer arrangement 10, according to a first embodiment or version of the invention, comprises a front or leading mobile tunnel boring unit 12 and at least one rear, trailing backup or auxiliary unit 14. The mobile tunnel boring unit 12 includes first drive means 16 to drive the mobile tunnel boring unit 12, a gripper arrangement 18 to facilitate boring (by providing the required gripping and thrusting), and a rotatable cutter head 20 fitted with cutters 22 to bore the tunnel face. The gripper arrangement 18 includes a front gripper assembly 24 and a rear gripper assembly 26. Each gripper assembly 24, 26 includes a support body 28, 30 and four movable gripper elements 32, 34 that can be extended and retracted, using first actuators (typically, hydraulic pistons), relative to the support body 28, 30. In the extended position, the gripper elements 32, 34 grip against the tunnel wall and in the retracted position, the first drive means 16 can be operated to move the mobile tunnel boring unit 12.

The gripper elements 32, 34 typically include gripper pads that are fitted on spherical joints. The spherical joints enable steering, both left and right steering and up and down steering. In use, the front gripper assembly 24 moves forwards with the cutter head 20, and the rear gripper assembly 26 extends out to engage against the tunnel. In particular, the front gripper assembly 24 stabilises the cutter head 20 while the rear gripper assembly 26 provides thrust. After advancing 1 metre, for example, the front gripper assembly 24 clamps against the tunnel and the rear gripper assembly 26 retracts. In one version, because there is no overall support for the mobile tunnel boring unit 12, the top two gripper elements 32, 34 can retract, to enable the mobile tunnel boring unit 12 to be dragged through the tunnel.

In an embodiment, the four movable gripper elements 32, 34 extend at 45 degree angles around the support body 28, 30, so as to define an X. The front and rear gripper assemblies 24, 26 are fitted to either end of a torque shaft housing 42 for accommodating a torque shaft that connects a gearbox 44 with the cutter head 20. Second actuators 46 (typically hydraulic pistons) are arranged to extend and retract the support body 28, 30 of the front gripper assembly 24 and the cutter head 20 relative to the torque shaft housing 42. In an embodiment, the cutter head 20 includes a central engaging face 48 with a plurality of (typically four) modular cutter segments 50 extending at an angle away from the central engaging face 48. This arrangement defines a tapered, self-centring arrangement. In one version, the cutter segments 50 can be removed from the cutter head 20 (similar to a raise borer head); in another version, the cutter segments 50 can be movably collapsible relative to the cutter head 20.

A dust shield 52 is provided between the front gripper assembly 24 and the cutter head 20. A conveyor arrangement 54 extends from the dust shield 52 to enable the muck and cuttings to be transported to a tunnelling truck 56 for subsequent disposal. The conveyor arrangement 54 comprises a first conveyer 58 on top of the mobile tunnel boring unit 12, to receive the cuttings via a chute 60 provided on the dust shield 52, and a second conveyor 62 on top of the backup unit 14 to continue conveying the cuttings towards the truck 56. In use, the rotating cutter head 20 lifts the cuttings as it rotates, and then dumps the cuttings into the chute 60, and then onto the first conveyor 58. In use, two trucks 56 may be used per borer arrangement 10, in a shuttling manner to haul muck away. One additional truck may be provided for every 750 m tunnel length.

The borer arrangement 10 includes a ventilation duct 64 that runs from the dust shield 52 all the way to a scrubber unit 66 at the back of the borer arrangement 10. The borer arrangement 10 further includes a fresh air pipe 68 to blow fresh air into the working area of the borer arrangement 10. In an embodiment, the borer arrangement 10 includes a support drill 70 and related platform 72, which is disconnected from the mobile tunnel boring unit 12. In use, as the borer arrangement 10 is drilling and vibrating, the support drill 70 and platform 72 will be stable, thereby allowing personnel to work on top of the platform 72. In particular, a person can stand on top of the platform 72 can perform the necessary drilling for the support work. This drilling would typically be done from −30 degrees from horizontal all the way around to −30 degrees on the other side.

The backup unit 14 includes second drive means 74 to drive the backup unit 14, and a support frame 76 on top of the second drive means 76. An advantage of having two separate units 12, 14 is to improve mobility and to allow all the required equipment, such as hydraulic power packs, gearboxes, motors, water and cable reels etc, to be arranged so as to provide a balanced arrangement. The borer arrangement 10 includes walkways 78 on both sides of the machine 10. In an alternate embodiment, instead of the cutter head and cutters cutting forwardly, as described above, they may be arranged to cut from the inside out. As a result, there is nothing pushing the borer arrangement back, thus simplifying the need for the gripper arrangements. This arrangement would also allow hydraulics and other equipment, and conveyors, to be brought through the centre of the head, and would allow hydraulic activation on the head in the front as well.

Figure 6A:
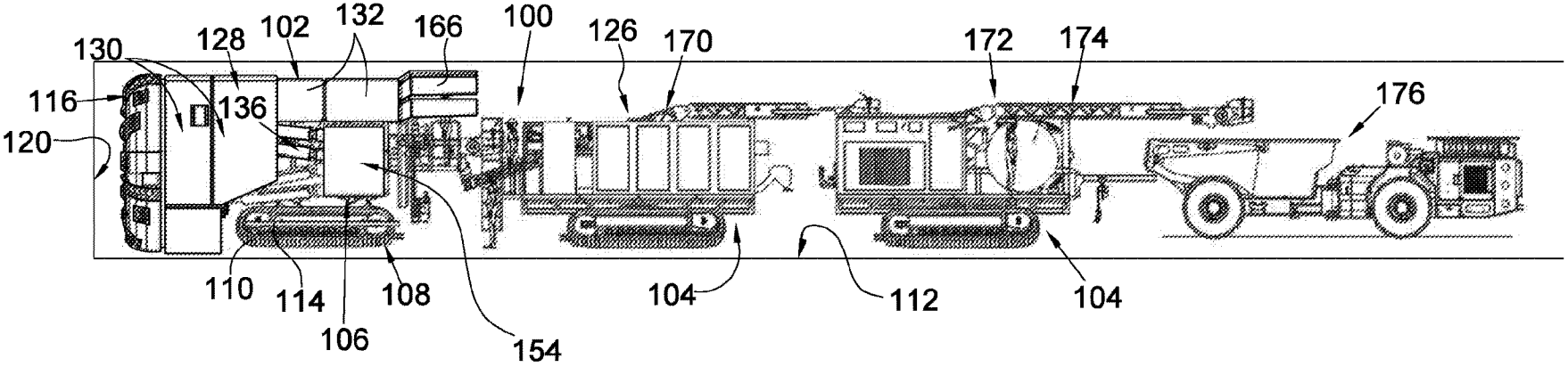
FIG. 6A shows a side view of a mobile underground tunnel borer arrangement, according to a first version of a second embodiment of the present invention, in use.
Figure 6B:
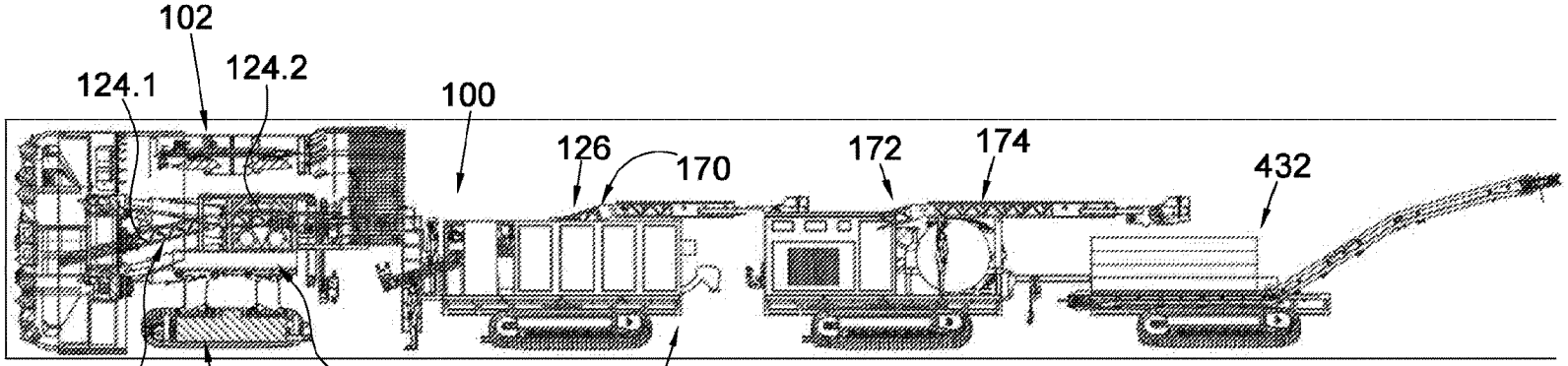
FIG. 6B shows a side view of a mobile underground tunnel borer arrangement, according to a second version of a second embodiment of the present invention, in use.
Figure 7:
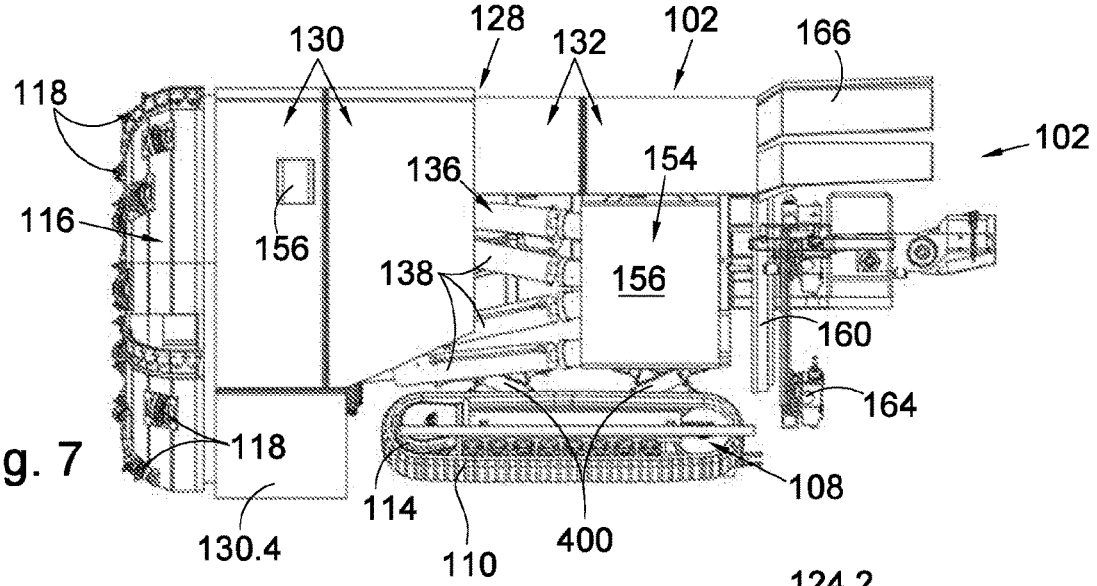
FIGS. 7 to 9 show various views of a mobile tunnel boring unit used in the mobile underground tunnel borer arrangement shown in FIG. 6A.
Figure 8:
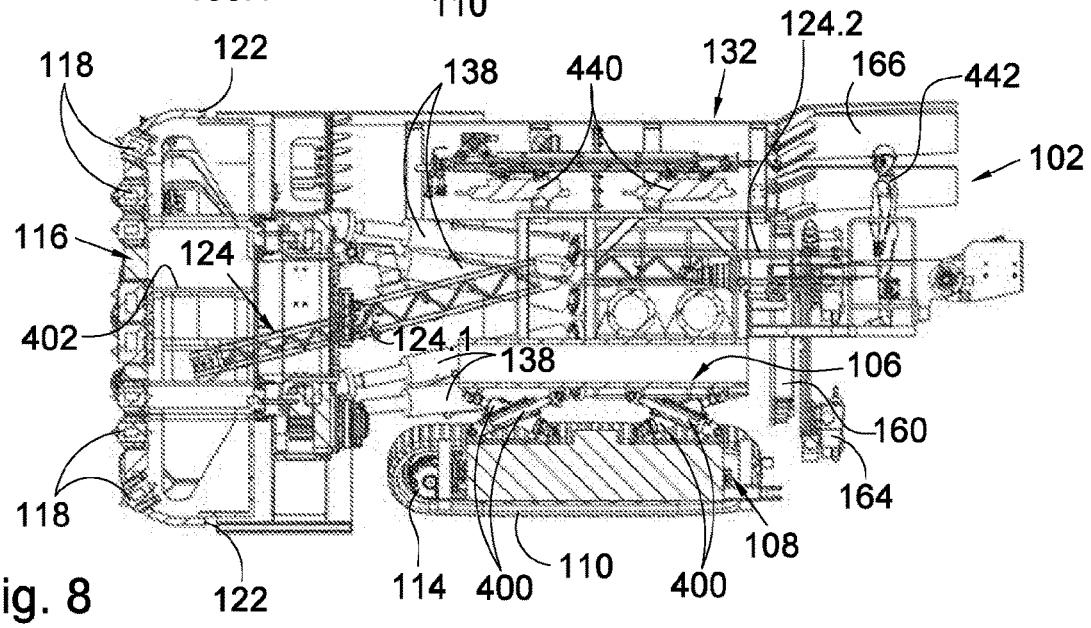
Figure 11A:
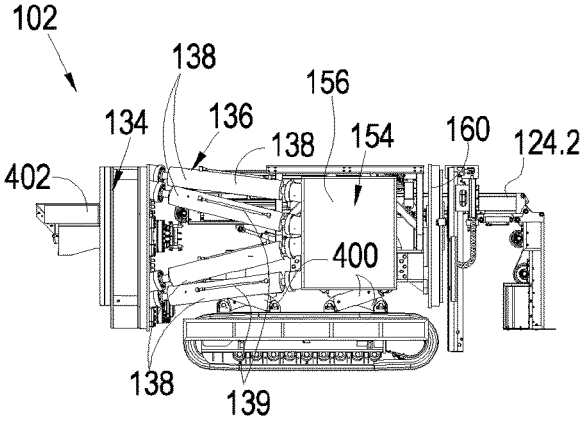
FIGS. 11A to 11C show various views of the mobile tunnel boring unit shown in FIG. 10.
Figure 11B:
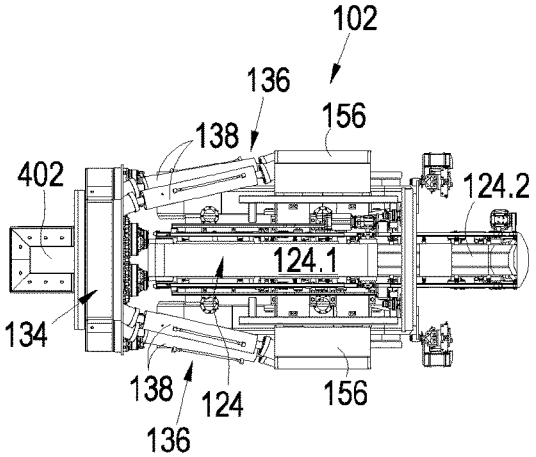
Figure 11C:
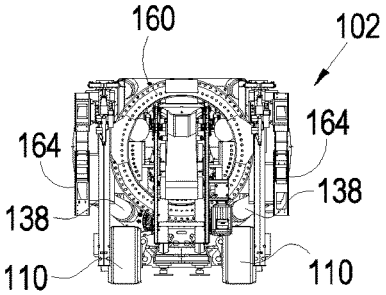
Figure 12:
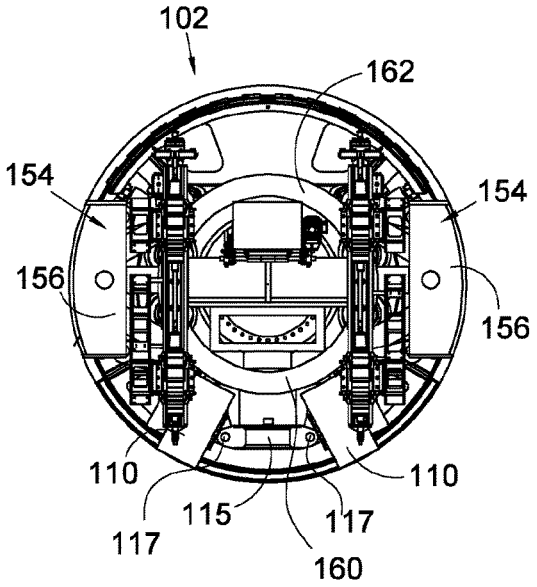
FIGS. 12 and 13 show front and rear cross-sectional views, similar to FIG. 11C, but in which a different lifting configuration is used.
Figure 13:
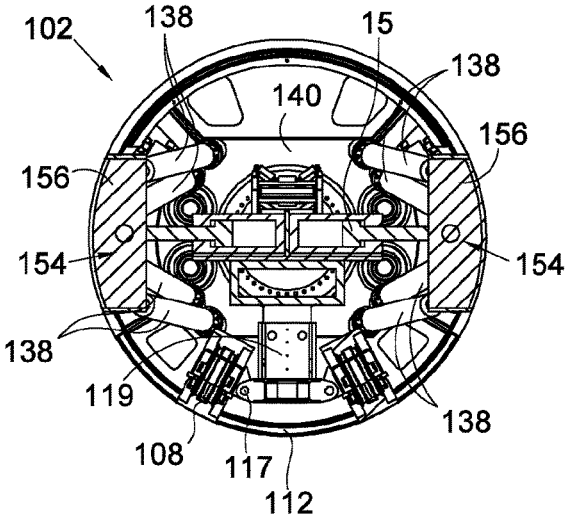

Turning now to FIGS. 6A to 16 of the drawings, a mobile underground tunnel borer arrangement 100, according to a second embodiment or version of the invention is shown. The borer arrangement 100 comprises a mobile tunnel boring unit 102 and at least one rear, trailing backup unit 104, as described in more detail further below. The mobile tunnel boring unit 102 includes a support body 106 (best shown in FIG. 8) driven by first drive means 108. The first drive means 108 for driving the mobile tunnel boring unit 102 includes a pair of spaced apart crawler tracks 110 in contact with the tunnel floor 112, and related track driving means 114 to move the tracks 110, and thus the support body 106 of the mobile tunnel boring unit 102. The tracks 110 are relatively wide to better support the mobile tunnel boring unit 102. In addition, as best shown in FIGS. 12 and 13, the tracks 110 are mounted to a cross support 115 with pivot pins 117, to better accommodate the round shape of the bored tunnel. In addition, a hydraulic cylinder 119 is fitted between the cross support 115 and the support body 106 (not shown), to lift the upper part of the boring unit 102 relative to the tracks 110 (which will be explained in more detail further below). This is one configuration of a lifting configuration to lift the support body 106 relative to the tracks 110 (the other configuration is described further below). This lifting arrangement conveniently accommodates the round bored tunnel and is particularly useful to accommodate varying diameters of the boring unit 102, as will be explained in more detail further below with reference to FIG. 17, and to ensure alignment when assembling the mobile tunnel boring unit 102 to a cutter head 116 (explained in more detail further below). As best shown in FIG. 8, another lifting arrangement is shown, comprising two pairs of criss-cross lifting cylinders 400. The cylinders 400 may be actuated to lift the support body 106 (and thus the upper portion of the mobile tunnel boring unit 102) relative to the tracks 110. The crawler tracks 110 are powered by a diesel powered hydraulic motivator, which is latched to the back of the mobile tunnel boring unit 102. The crawler tracks 110 are operated by a handheld remote control, by one operator in close proximity to the boring unit 102.

Figure 23:
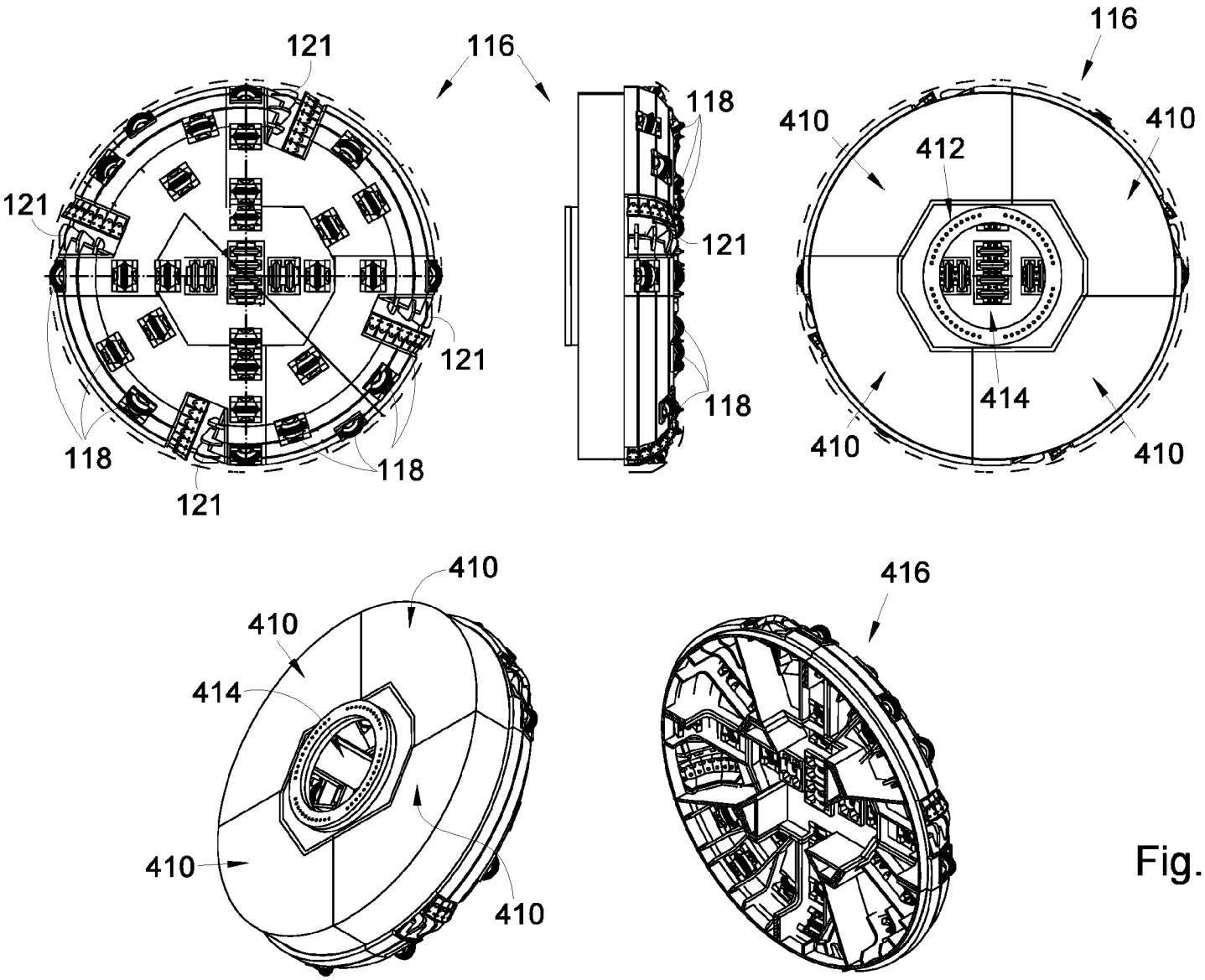
FIG. 23 shows various views of a cutter head used in the mobile tunnel boring unit of the present invention.
Figure 24:
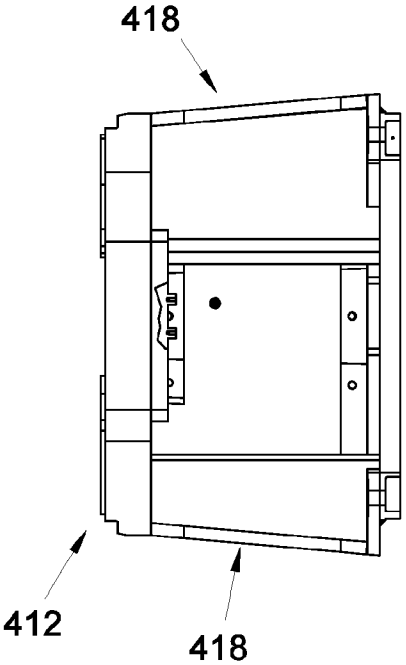
FIG. 24 shows various views of a central cutter head component of the cutter head shown in FIG. 23.
Figure 24:
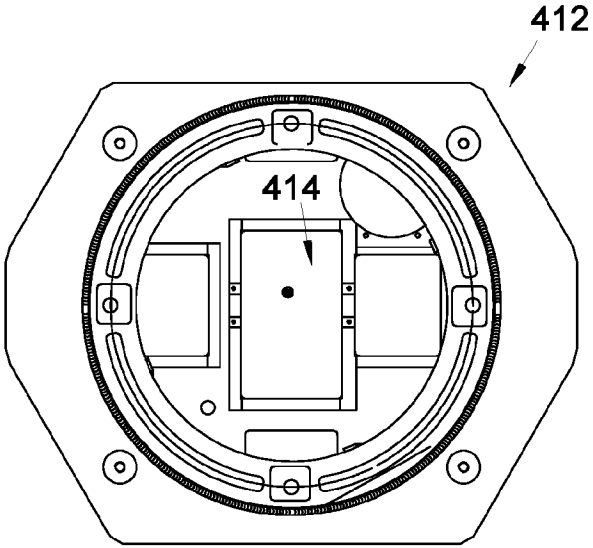
Figure 24:
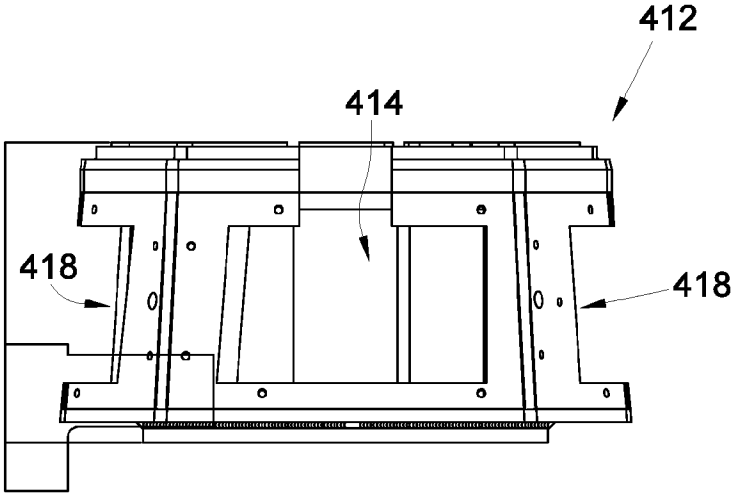

As best shown in FIGS. 7, 8, 9 and 23, the mobile tunnel boring unit 102 further comprises a round rotatable cutter head 116 fitted with cutters 118 to bore the tunnel face 120 shown in FIG. 6A. The round bored tunnel is particularly advantageous in underground situations, primarily due to its inherent strength. In the illustrated version, the cutter head 116 includes a full face cutter head 116 with disc cutters 118, the cutter head 116 defining scoops 121 (best shown in FIG. 23) and channels 122 (best shown in FIG. 8) to allow cuttings and muck to pass automatically through the cutter head 116 for discharge into a muck hopper 402 (best shown in FIGS. 10 and 11B) and collection onto a first conveyor arrangement 124 located immediately behind the cutter head 116 (as best shown in FIG. 8). With particular reference to FIGS. 23 and 24, the cutter head 116 comprises four peripheral modular cutter segments 410 and a central cutter head segment 412. The size of the peripheral cutter segments 410 are variable, depending on the size of the tunnel to be bored, while the central cutter head segment 412 remains the same irrespective of the tunnel size, so as to define a common centre. The central cutter head segment 412 defines a central aperture 414 to enable the back loading of the cutters 118, as best shown in the cross-sectional perspective view indicated by arrow 416. As best shown in FIG. 24, the central cutter head segment 412 has tapered side walls 418, with the corresponding inner faces of the peripheral cutter segments 410 being tapered accordingly. This ensures a tight fit between the segments 410 and 412, with the central cutter head segment 412 in turn being connected to the main drive 134 (discussed further below) using a quick connection arrangement. In use, and as shown in FIG. 8, the muck hopper 402 extends through the central aperture 414 of the central cutter head segment 412 to receive the cuttings for transport by the first conveyor arrangement 124.

Figure 10:
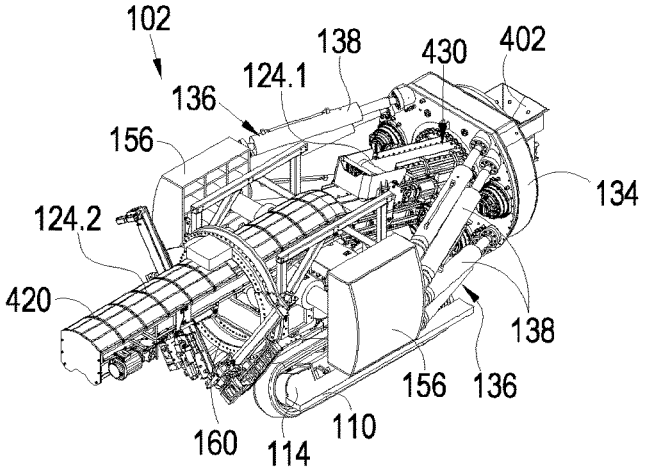
FIG. 10 shows a perspective view of the mobile tunnel boring unit shown in FIGS. 7 to 9, but without a cutter head or a telescopic shield arrangement fitted.

As best shown in FIGS. 6B, 8 and 10, the first conveyor arrangement 124 extends through the mobile tunnel boring unit 102 for subsequent offloading onto a first backup unit 126, which is described in more detail further below. The first conveyor arrangement 124 comprises a front conveyor section 124.1 and a rear conveyor section 124.2, with the front conveyor section 124.1 being retractable away from the cutter head drive means 134, out from under the muck hopper 402, to allow access for cutter change and maintenance. The rear conveyor section 124.2 is typically enclosed under a cover 420, which is primarily used as a safety measure and to reduce dust within the mobile tunnel boring unit 102.

The mobile tunnel boring unit 102 is fitted with a telescopic shield arrangement 128, as best shown in FIGS. 6A, 7, 9, 14A, 14B and 14C. The shield arrangement 128 comprises a front shield 130 proximate the front of the mobile tunnel boring unit 102, from which the cutter head 116 protrudes, and a rear shield 132 that surrounds at least an upper portion of the mobile tunnel boring unit 102. The front and rear shields 130, 132 operate telescopically relative to each other, to assist the mobility and agility of the boring unit 102 as the boring direction changes and curves. The front shield 130 in turn comprises a plurality of peripheral modular segments 130.1 to 130.4 joined together, which further assists with the compact and manoeuvrable design of the mobile tunnel boring unit 102. The shield arrangement 128 thus provides a fully supported zone proximate the tunnel face 120 being bored. The peripheral segments 130.1 to 130.4 define an aperture 131 in the middle, to accommodate the front conveyor section 124.1 therethrough. One of the segments 130.1 to 130.4 is a bottom/belly shield segment 130.4, which stabilises the mobile tunnel boring unit 102, in cooperation with gripper pads 156 (explained in more detail further below), by skidding on the tunnel invert at all times. The belly shield segment 130.4 is equipped with replaceable wear plates to extend its operating lifespan. The shield arrangement 128 is modular to ease transport, by limiting size and weight. The shield arrangement 128 is designed to be assembled quickly and efficiently, with reference to FIG. 22R as well, with the shield interface providing quick alignment and easy access for fasteners.

The front shield 130 (together with the cutter head 116, as described above) can be detached from the rest of the mobile tunnel boring unit 102, and is typically pre-installed in a starting chamber, as will be described in more detail further below with reference to FIGS. 21A to 21G, and in FIGS. 22A to 22W. The front shield 130 accommodates cutter head drive means 134, best shown in FIGS. 9, 10, 10B and 11, to rotatingly drive the cutter head 116. The cutter head drive means 134 is mounted onto the cutter head 116, and typically comprises hydraulic drive motors that drive a ring gear which is stabilised by a thrust bearing. A sealing arrangement is used to prevent against the ingress of dust, thereby preventing against dust from penetrating the cutter head drive means 134. The drive means 134 defines an aperture 430 in the middle, as best shown in FIG. 10, to accommodate the front conveyor section 124.1 therethrough. The aperture 430, in conjunction with the central aperture 414 of the central cutter head segment 412, facilitates access to the cutters 118, for ongoing maintenance.

As will be described in more detail below with reference to FIGS. 21B, 21C and 21D in particular, the cutter head drive means 134 is shaped specifically to aid fast assembly of the front shield 130 in the correct sequence. In addition, a quick attachment method was developed to aid fast assembly/connection between the cutter head drive means 134 to the cutter head 116 when the cutter head 116 has been assembled in the cutting face. As indicated above, and with particular reference to FIGS. 6A, 6B and 17, the cutter head 116 may also have varying sizes, as required in use. In particular, these figures show two possible diameter sizes of the mobile tunnel boring unit 102 of the mobile underground tunnel borer arrangement 100, namely a 5.5 metre diameter machine (shown in FIG. 6B and indicated by arrow 180 in FIG. 17), and a 4.5 metre diameter machine (shown in FIG. 6A and indicated by arrow 182 in FIG. 17). Significantly, an identical mobile tunnel boring unit 102 can be used for both sizes, with only the shield arrangement 128 (and in particular the front shield 130) and the cutter head 116 needing to be changed. In addition, the central cutter head segment 412 described above allows the four peripheral cutter segments 410 for the 4.5 m and 5.5 m configurations to be secured in place (described further below with reference to FIGS. 22K, 22L and 22M). For the 5.5 metre diameter machine 180, an additional bunker car 432 is typically used to provide additional storage capacity, as shown in FIG. 6B.

Figure 17:
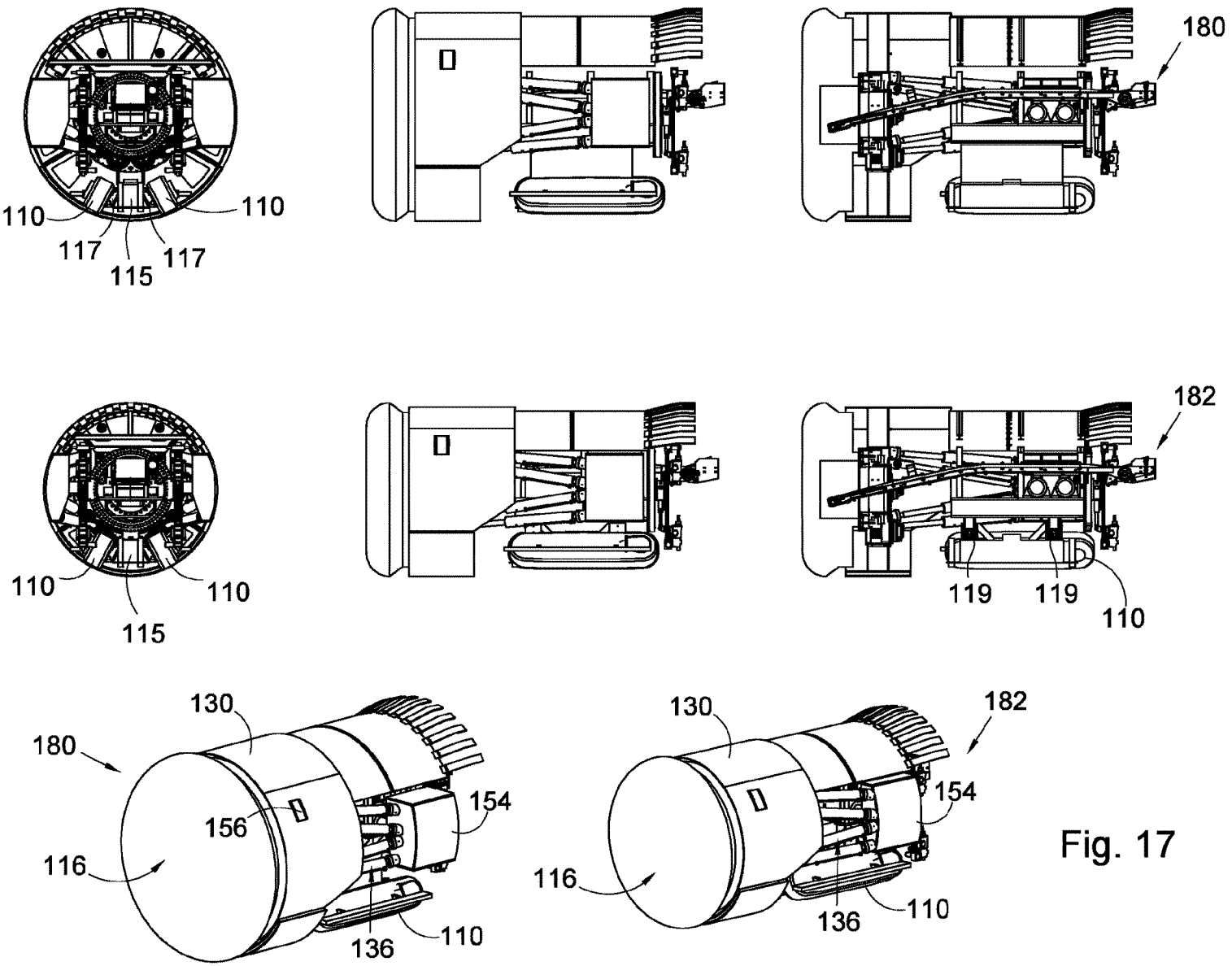
FIG. 17 shows two possible diameter sizes of the mobile tunnel boring unit of the mobile underground tunnel borer arrangement, corresponding to the versions shown in FIGS. 6A and 6B, which can be relatively easily interchanged by simply changing the shield arrangement and the cutter head.

FIGS. 6A, 6B and 17 show the relative positioning of the support body 106 (and thus the upper part of the mobile tunnel boring unit 102), relative to the tracks 110, depending upon the machine size. Thus, for example, in the 4.5 metre configuration (i.e. FIG. 6A, and arrow 182 in FIG. 17), the cylinder 119 (in one configuration) or the cylinders 400 (in the other configuration) are retracted, in order to lower mobile tunnel boring unit 102 (and in particular the support body 106). Conversely, in the 5.5 metre configuration (i.e. FIG. 6B, and arrow 180 in FIG. 17), the support body 106 and mobile tunnel boring unit 102 are raised, with the cylinders 119, 400 accordingly being extended.

Turning now to FIGS. 10, 11A and 11B, an actuating arrangement 136, comprising a plurality of hydraulic thrust cylinders 138, extends between the cutter head drive means 134 and a pair of opposite gripper assemblies 154. The connection of the thrust cylinders 138, on both ends, takes the form of spherical ball joints 140, to allow free movement. The front shield 130 is secured to the outside of the main drive 134, whereas the rear shield 132 is secured to the rear end of the mobile tunnel boring unit 102, as shown in FIG. 22V. In this way, the actuating arrangement 136 is arranged to telescopingly move the front shield 130 relative to the mobile tunnel boring unit 102 (and thus the rear shield 132). This telescoping movement further assists with the compact and manoeuvrable design of the mobile tunnel boring unit 102.

Figure 15:
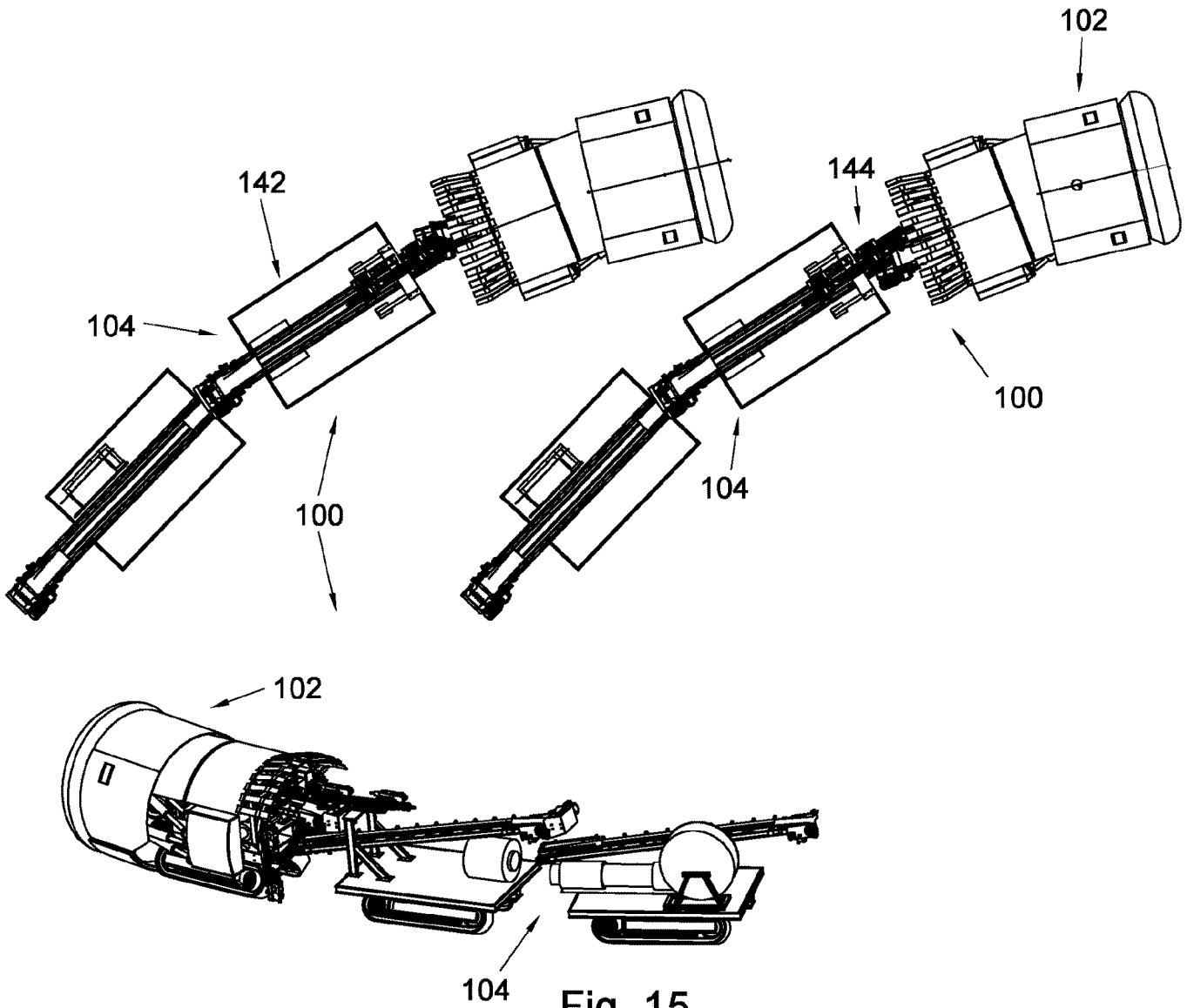
FIG. 15 shows various views of the mobile underground tunnel borer arrangement being steered.

The thrust cylinders 138, typically four pairs of thrust cylinders, two pairs on either side of the unit 102, extend slightly inwardly from the gripper assemblies 154 towards the cutter head drive means 134, as best shown in FIG. 11B. This enables the mobile tunnel boring unit 102 to be steered in all directions (i.e. up, down, left and right, and thus even enabling spiral shafts to be bored), as best shown in FIG. 15. In this figure, two paths 142, 144 are shown; in the first path 142, the cutter head 116 extends at an angle of 8.2 degrees relative to the rest of the borer arrangement 100, whereas in the second path 144, the cutter head 116 extends at an angle of 7.9 degrees relative to the rest of the borer arrangement 100. The mobile tunnel boring unit 102 has a turning radius of approximately 30 metres.

The arrangement of the thrust cylinders 138 acts as a flexible link between the cutter head drive means 134 and the rest of the mobile tunnel boring unit 102, which allows for correction of the mobile tunnel boring unit 102 after rotational slippage. The thrust cylinders 138 are equipped with position sensors 139, enabling the mobile tunnel boring unit 102 to establish the position of the cutter head 116 relative to the rest of the mobile tunnel boring unit 102 (and in particular the gripper assemblies 154).

The mobile tunnel boring unit 102 includes a gripper arrangement to facilitate boring (by providing the required gripping and thrusting). The gripper arrangement includes a pair of front, relatively smaller, gripper assemblies 152 (best shown in FIGS. 7 and 9), arranged to protrude from the front shield 130, and a pair of rear, relatively larger gripper assemblies 154, fitted to, so as to extend from, the support body 106. In particular, the smaller, gripper assemblies 152 define a V (and thus extend radially upwardly at 45 degrees), on either side of an upper edge of the front shield 130. The larger gripper assemblies 154 extend on opposite sides of the mobile tunnel boring unit 102, with cylinder barrels 155 (best shown in FIG. 9) being carried on the support body 106, for guiding the movement of the gripper assemblies 154. The gripper assemblies 154 include movable, curved gripper elements 156. Under the control of the thrust cylinders 138, the gripper assemblies 154 can be extended and retracted, relative to the mobile tunnel boring unit 102. In the extended position, the gripper elements 156 grip against the tunnel wall, and in the retracted position, the mobile tunnel boring unit 102 is free to move forwards. In particular, in use, the mobile tunnel boring unit 102 remains in contact with the floor. After the rear gripper assembly 154 retracts, the smaller gripper assembly 152 extends, with the actuating arrangement 136 then being used to pull the rear of the mobile tunnel boring unit 102 forwards. Thus, rear gripper assembly 154 provides thrust, while the smaller gripper assembly 152 provides stabilisation. In an embodiment, the curved gripper elements 156 take the form of curved gripper pads that are fitted on pin type spherical joints to accommodate free movement and minimise pressure on the rock formation.

Figure 16:
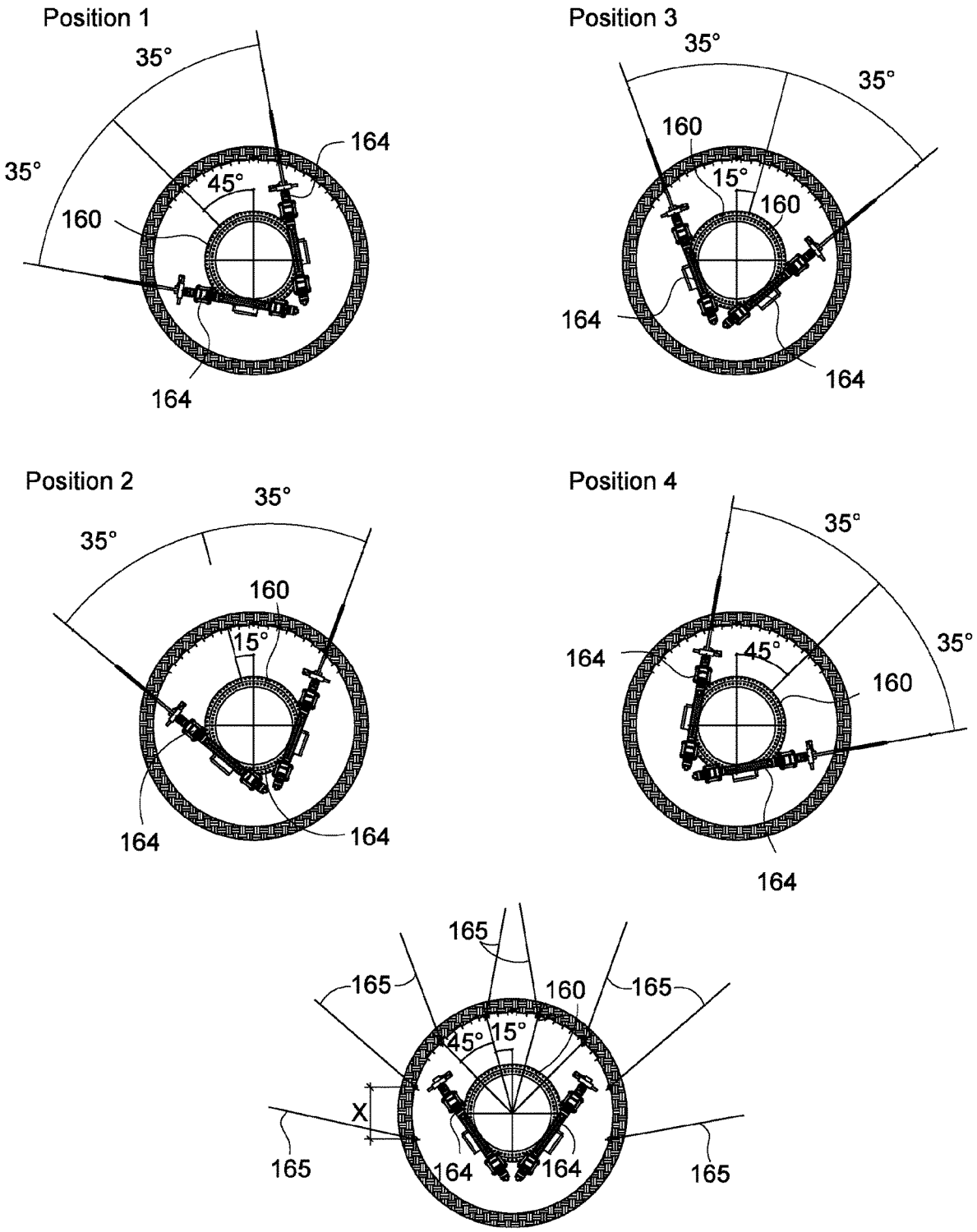
FIG. 16 shows a support drilling pattern followed by support drills fitted to the mobile tunnel boring unit of the mobile underground tunnel borer arrangement.

As best shown in FIG. 10, the mobile tunnel boring unit 102 further includes a support drill rotation ring 160, and associated ring drive means 162 to rotate the ring 160 through 270 degrees, fitted proximate the rear end of the mobile tunnel boring unit 102. The support drill rotation ring 160 carries two spaced apart drills 164, to facilitate the fitting of rock bolt supports to the surrounding wall, and which can operate simultaneously to increase productivity i.e. the support bolts are drilled and installed simultaneously. As best shown in FIG. 16, the drills 164 are typically fitted to the rotation ring 160 to define a V-configuration. Roof bolts of up to 3 metres in length and/or support mesh can be fitted using this arrangement, as indicated by lines 165 in the fully drilling pattern. Thus, is use, the ring 160 rotates through 270 degrees, stopping at four distinct positions or intervals, as shown, to enable the drills 164 to drill holes into the surrounding wall. The result is eight drilled holes 165, spaced apart at the wall, as indicated by x, by around 1.165 m.

Figure 9:
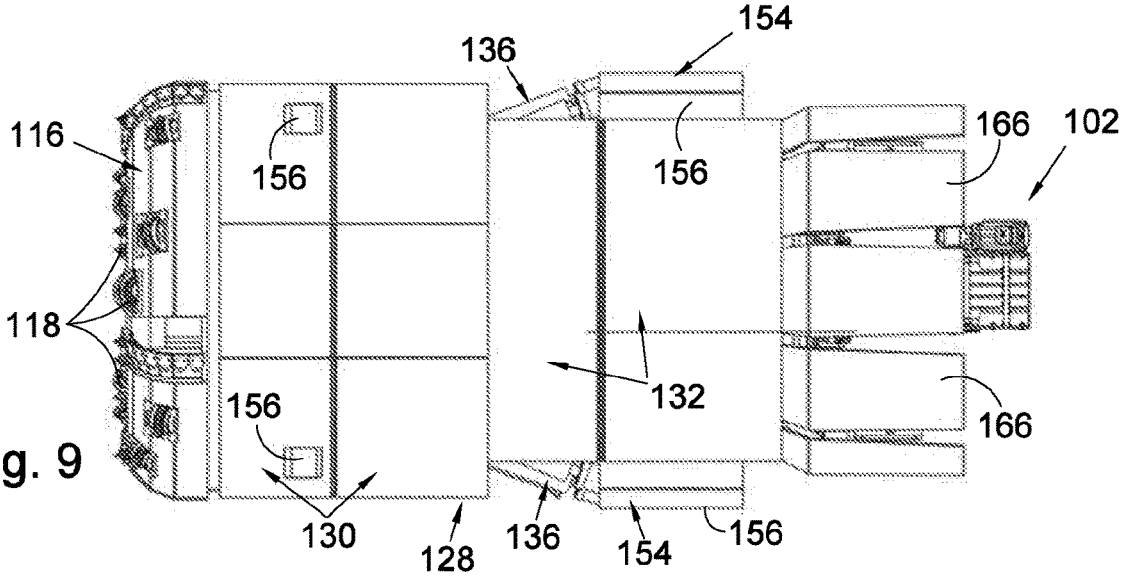

Significantly, the ring 160 and drills 164 define an on-board rock support bolting system that can provide support while the mobile tunnel boring unit 102 is busy excavating. This results in a fully supported excavation, with the front shield 130 defining a primary support, and the roof bolts defining a secondary support. In addition, the mobile tunnel boring unit 102 includes one or more probe drills 440, as best shown in FIG. 8, safely housed within the rear shield 132. This allows drilling in advance, typically up to 30 metres, to locate bad ground conditions and/or water ahead of the boring unit 102. The probe drill position and orientation can be manually adjusted to allow cover drilling in three directions through the cutter head 116 and the front shield 130. In an embodiment, as best shown in FIGS. 7 to 9, the rear shield 132 includes a plurality of fingers 166 that define gaps through which the drills 164 can extend and drill. These fingers 166 guide and assist in the drilling operation of the support drills 164. The fingers 166 are hydraulically actuated to provide adjustment during transport and also to support the tunnel wall during support drilling, to protect the support drill operators 442 (as best shown in FIG. 8).

Figure 18A:
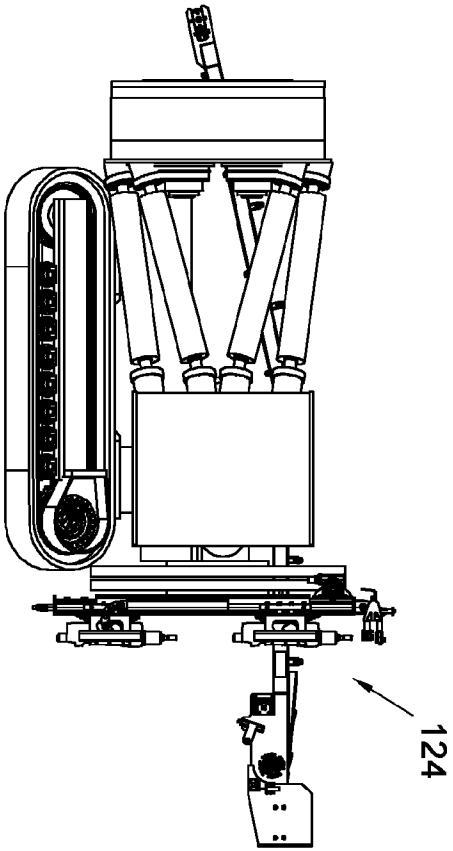
FIGS. 18A and 18B show the collapsibility of a first conveyor arrangement provided on the mobile tunnel boring unit.
Figure 18B:
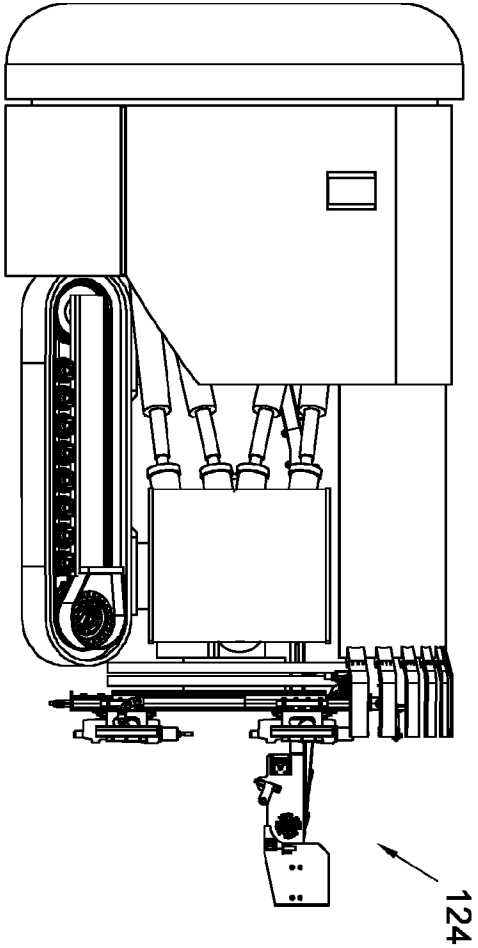
Figure 19A:
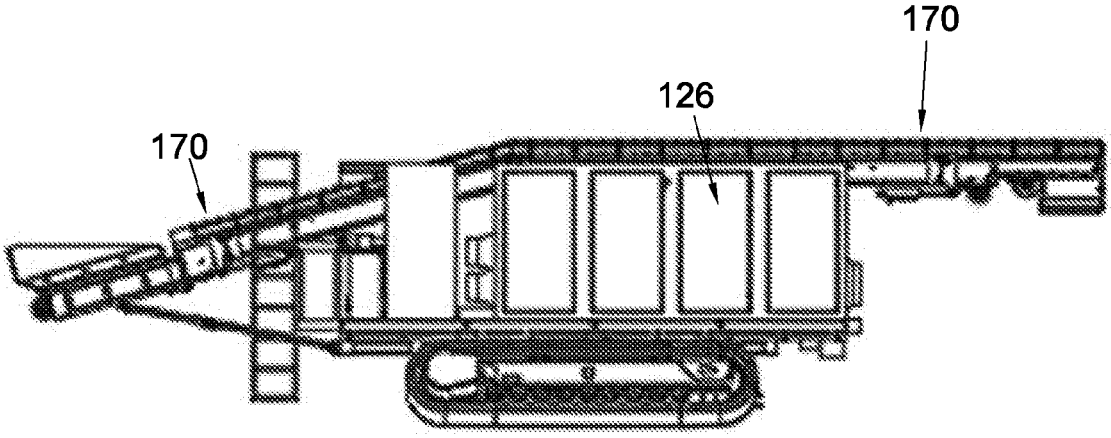
FIGS. 19A to 19C show the collapsibility of a second conveyor arrangement provided on a first backup or auxiliary unit.
Figure 19B:
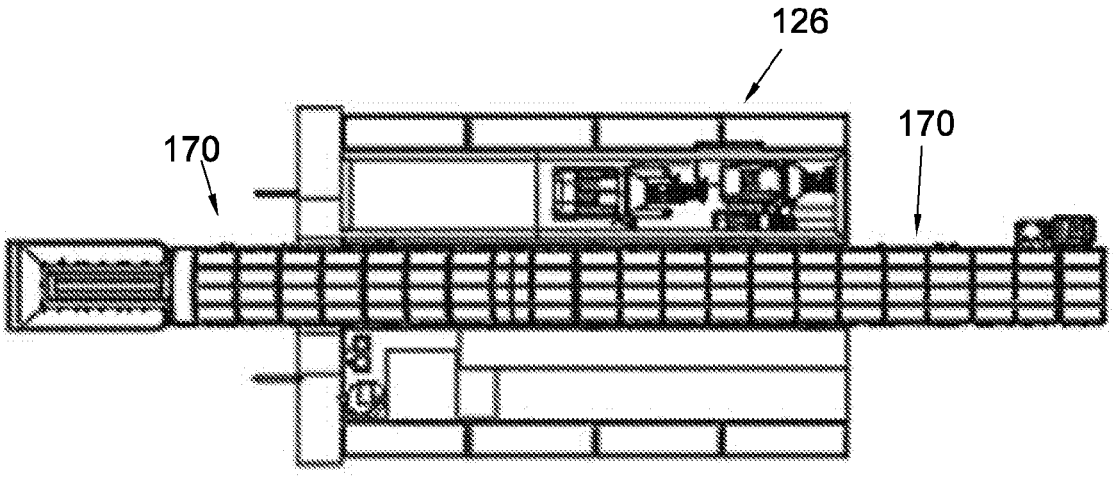
Figure 19C:
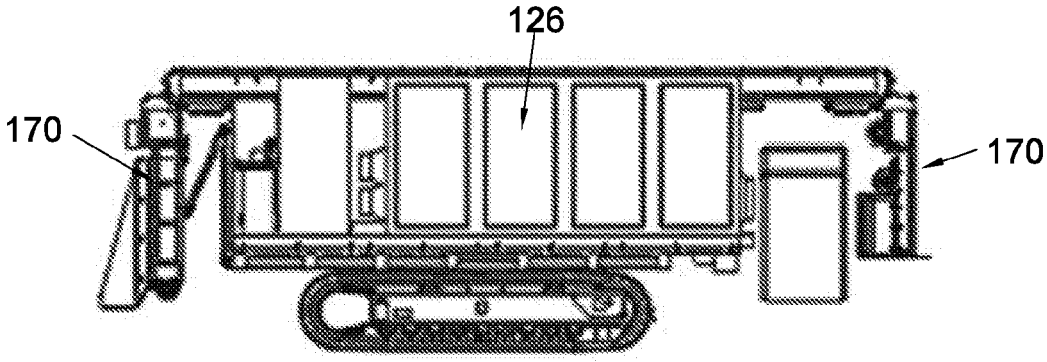
Figure 20A:
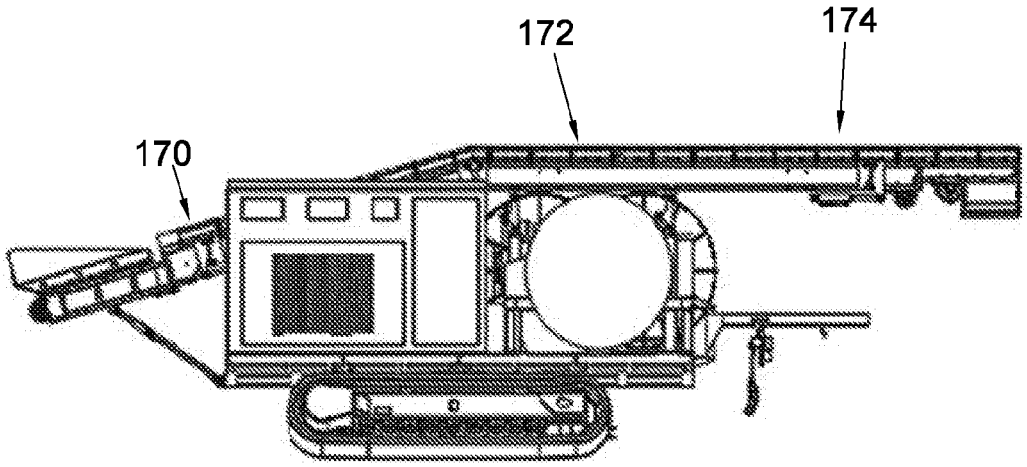
FIGS. 20A to 20C show the collapsibility of a third conveyor arrangement provided on a second backup or auxiliary unit.
Figure 20B:
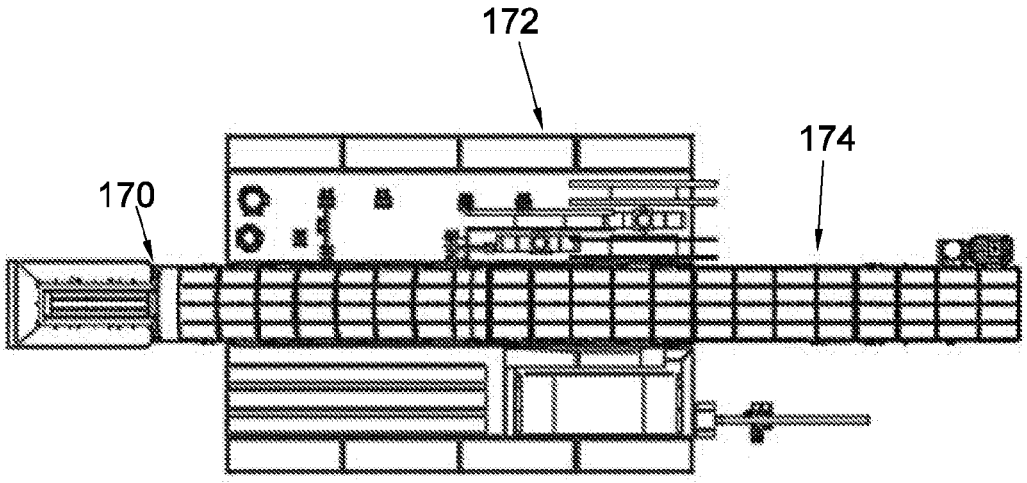
Figure 20C:
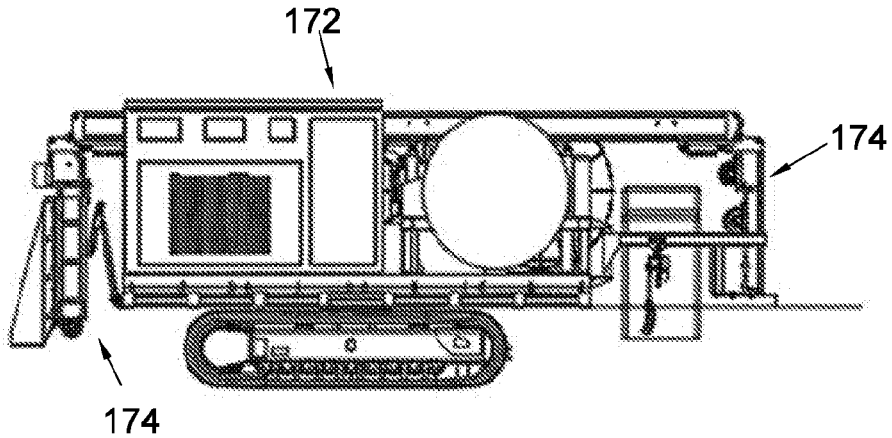

Referring back to FIGS. 6A and 6B, the first backup unit 126 is fitted with a second conveyor arrangement 170 to transport the cuttings and muck from the first conveyor arrangement 124 on the mobile tunnel boring unit 102 towards a second backup unit 172. The first backup unit 126 is fitted with the main hydraulic power pack, and an electric panel that is equipped with a PLC system. The first backup unit 126 is also fitted with a scrubber unit to assist with dust suppression. In an envisaged arrangement, the second backup unit 172 is fitted with a third conveyor arrangement 174 to receive the cuttings and muck from the second conveyor arrangement 170 on the first backup unit 126 towards a truck 176. In an embodiment, the second backup unit 172 is fitted with a cooling water circulation pumping system. The second backup unit 172 is also fitted with a main incoming transformer substation and also a dust extraction fan unit. Cable and hose reels are fitted as well to allow continuous operation for a distance of 300 meters. In addition, the first, second and third conveyor arrangements 124, 170, 174 are all collapsible, so as to improve and facilitate manoeuvrability, as shown in FIGS. 18A and 18B, 19A to 19C and 20A to 20C. In particular, the end portions of the conveyor arrangements 124, 170, 174 can be folded or pivoted downwardly, as best shown in FIGS. 18A, 19A and 20A. In addition, the conveyor arrangements 124, 170, 174 are designed with variable geometry, to enable them to be compacted to assist manoeuvrability during transportation. The conveyor arrangements 124, 170, 174 have a modular design to enable common parts inventory to ease spares and maintenance requirements.

Advantageously, the borer arrangement may be monitored and controlled remotely, and is thus safe for working personnel.

In use, turning now to FIGS. 21A to 21G, and further below to FIGS. 22A to 22W, the utilisation of relatively smaller components, when compared to traditional TBMs, means that after preparing a starting chamber for the borer arrangement, the borer arrangement can advance blind, typically according to a preprogramed route. Typically, with reference to FIG. 21A, a site is prepared by having a box-cut starting chamber 200 prepared, with a typical height of 6 meters and a length of around 12 metres. The site is further prepared by drilling supports for the chamber 200, as shown by arrow 202. Shuttering is then installed (arrow 204) with an LHD truck, with concrete then being pumped by a truck mixer (arrow 206). The compact design of the units 102, 126, 172 allows each one to be transported within existing tunnels and vertical shafts (i.e. each unit can fit into a standard cage), with all components being easily and quickly assembled and disassembled. Conveniently, in this regard, the various components of the invention are all designed to be no higher than 2 metres. In a transport configuration, in which the various segments of the cutter head 116 and the front and rear shields 130, 132 are removed, the mobile tunnel boring unit 102 has a length of around 5.565 metres. In the boring configuration, which includes the cutter head 116 and the front and rear shields 130, 132, the mobile tunnel boring unit 102 has a length of around 8.875 metres.

Figure 21A:
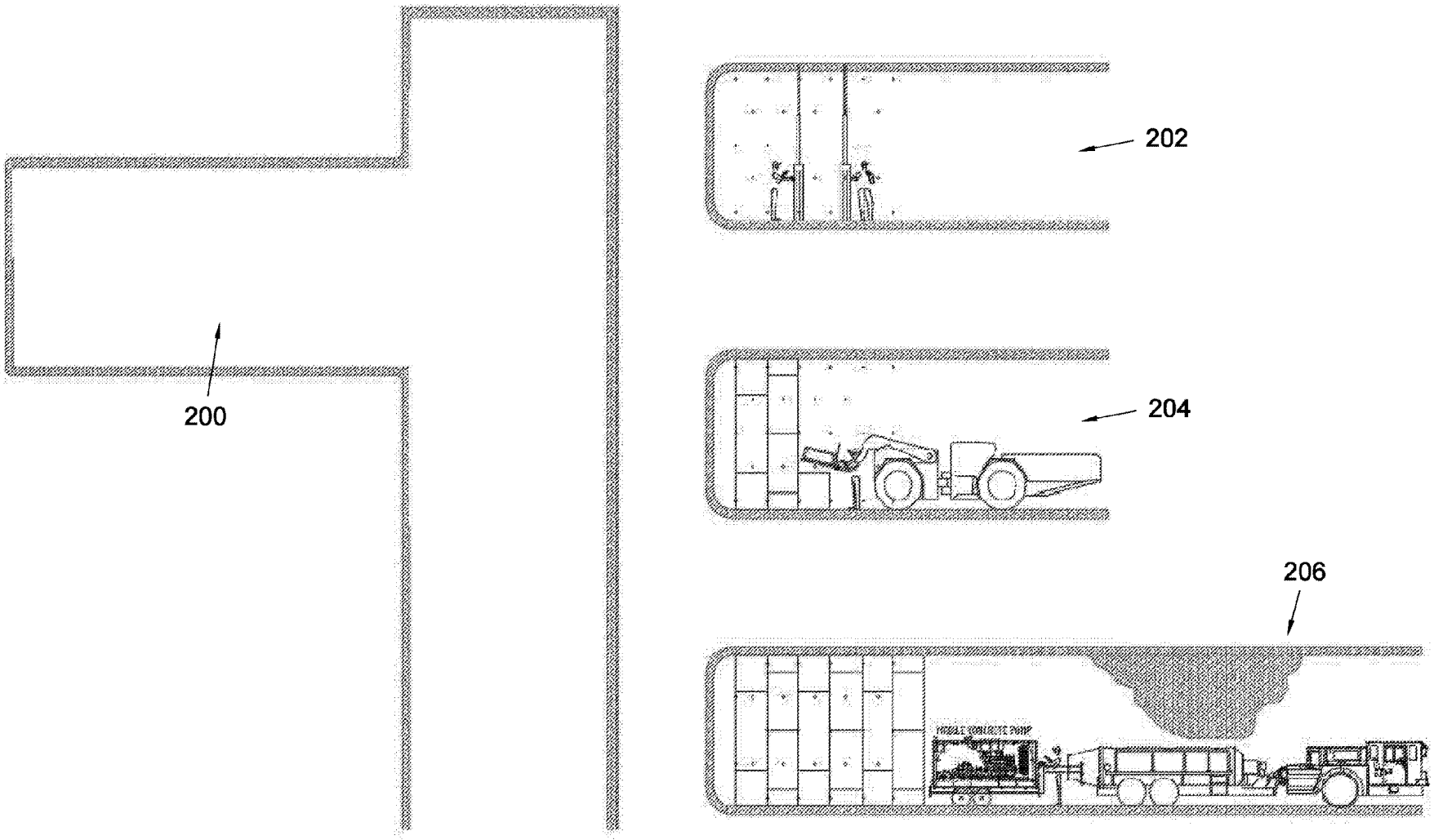
FIGS. 21A to 21G show a typical sequence of the steps involved onsite.
Figure 21B:
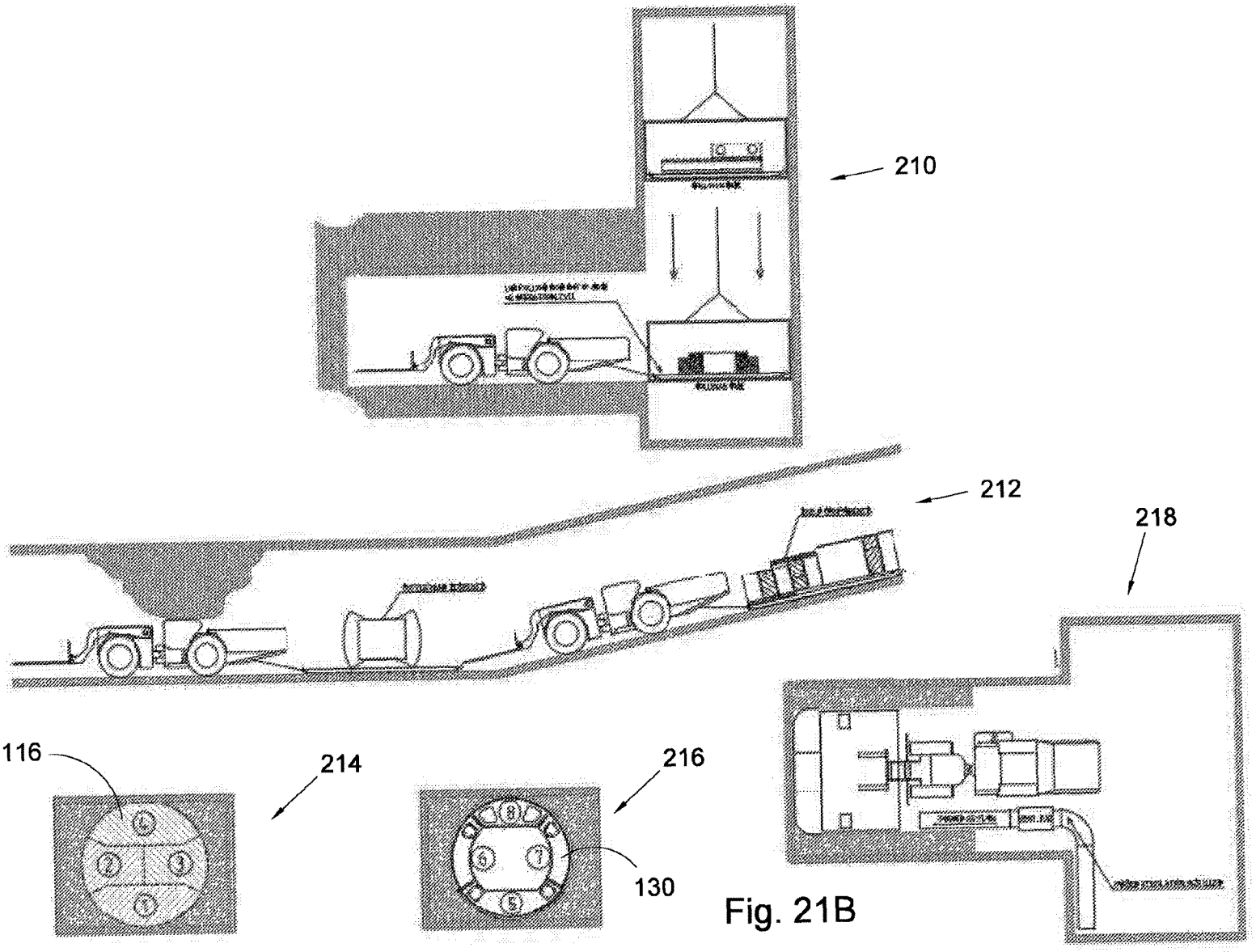

Once the site has been prepared, with reference now to FIG. 21B, the machine sections are transported down the shaft in a cage, as shown by arrow 210. Material may then be transported down a decline shaft, provided there is at least a 2 metre passage height, as shown by arrow 212. In an embodiment, the cutter head 116 is detachably secured to the mobile tunnel boring unit 102 with a quick attachment method (described further below with reference to FIGS. 22U, 22V and 22W), which improves the efficiency of the boring cycle. In addition, the cutter head 116 comprises a plurality of segments that can be pre-assembled and pre-installed, typically together with the front shield (described above and further below with reference to FIGS. 22K, 22L and 22M). The centre segment 412 has a tapered profile to ensure accurate segment attachment, as described above. Thus, upon preparation, the front shield 130 (together with the cutter head 116, as described above) can be pre-installed in the starting chamber 200, as indicated by arrows 214 and 216 respectively. Once done, the starting chamber 200 is ready for the mobile underground tunnel borer arrangement 100 of the invention, as shown by arrow 218.

Figure 21C:
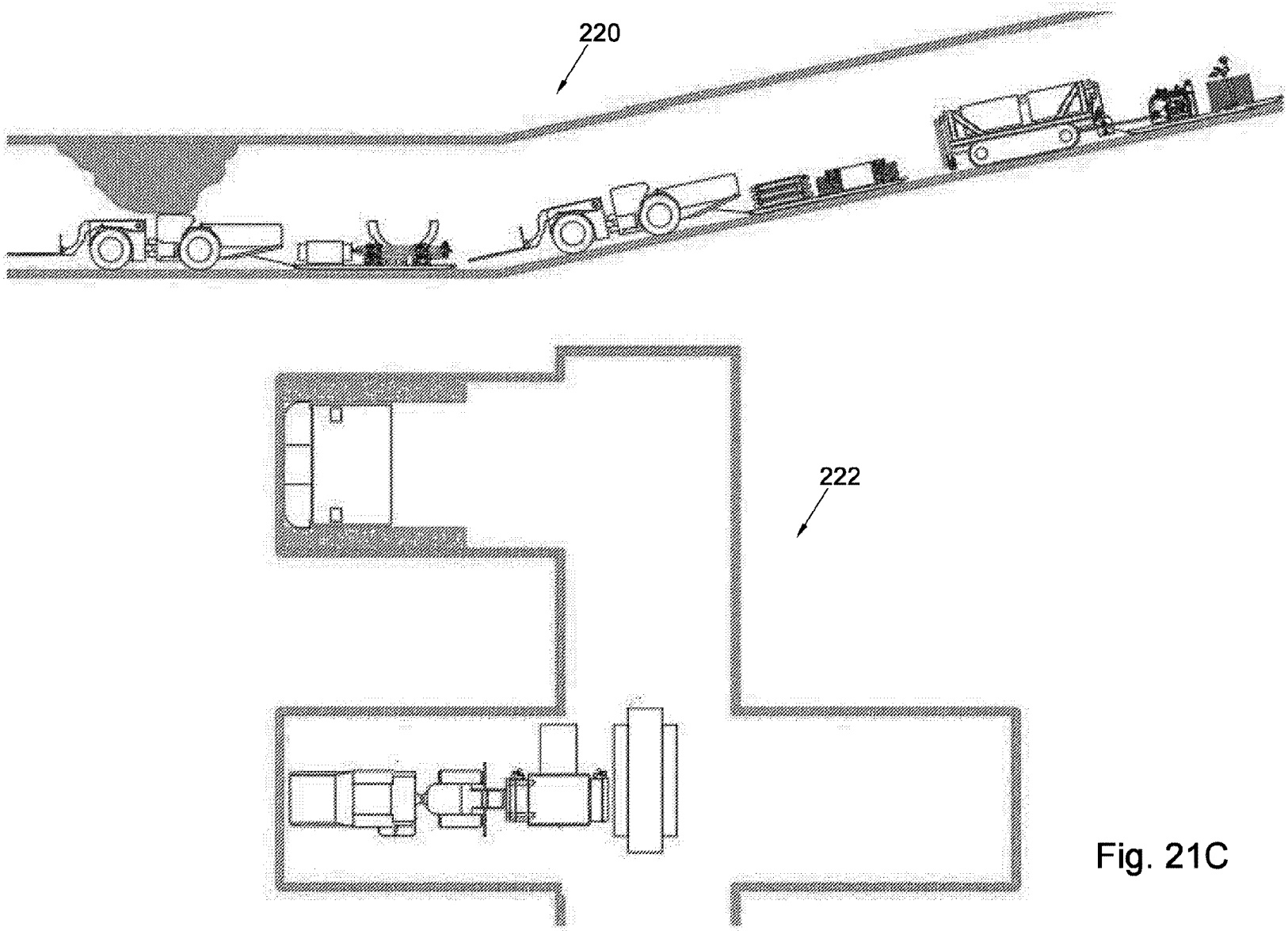
Figure 21D:
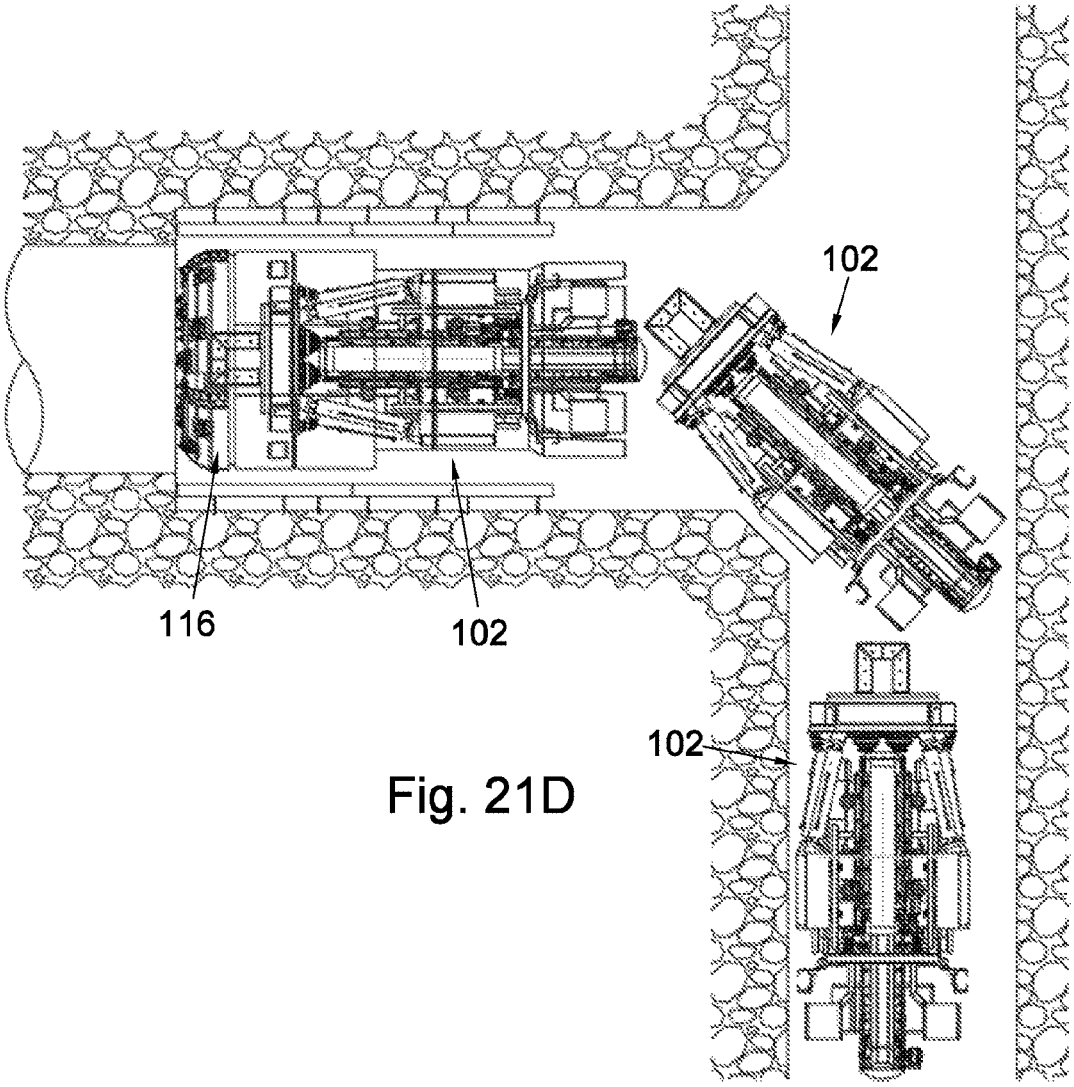
Figure 21E:
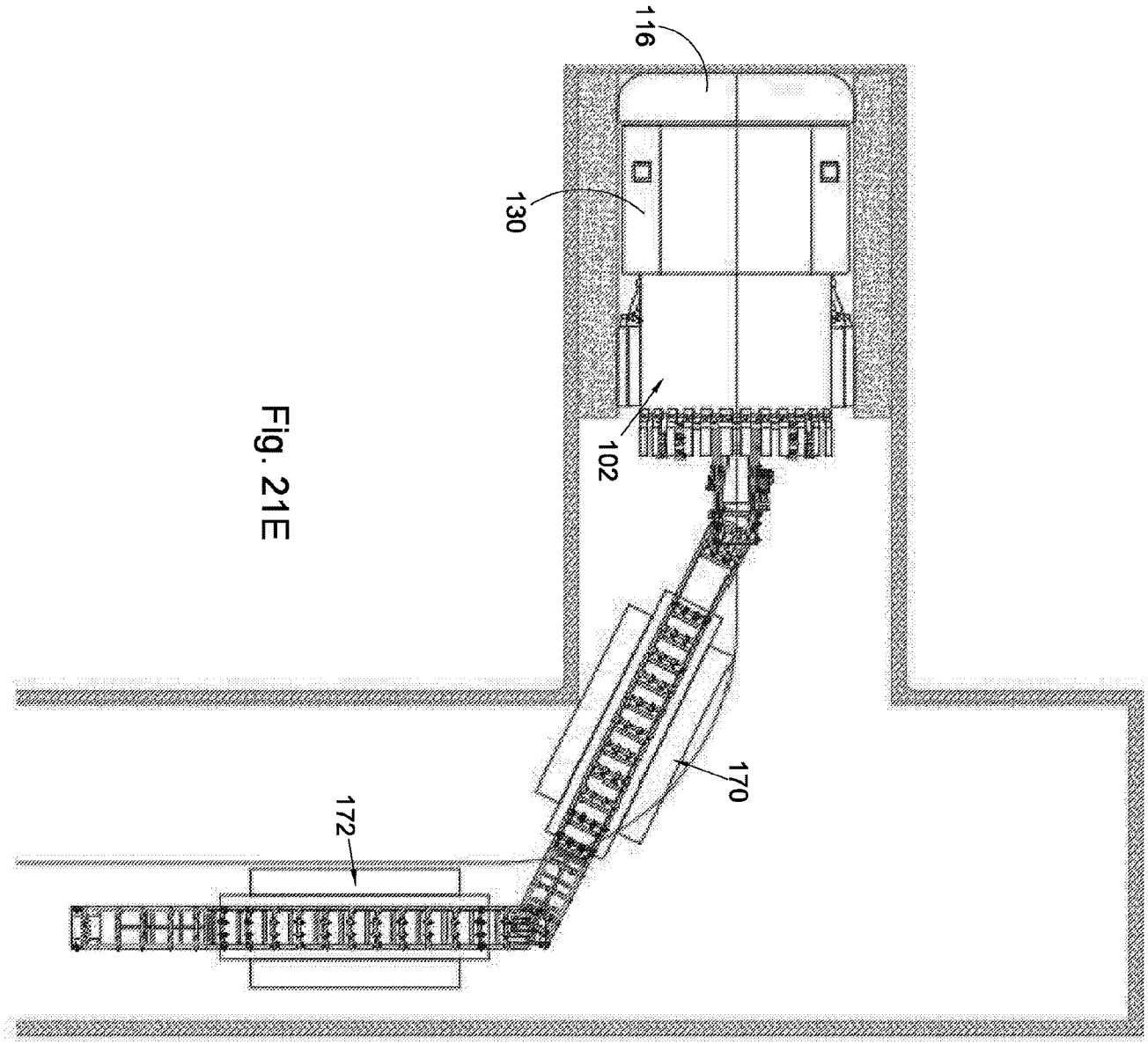
Figure 21F:
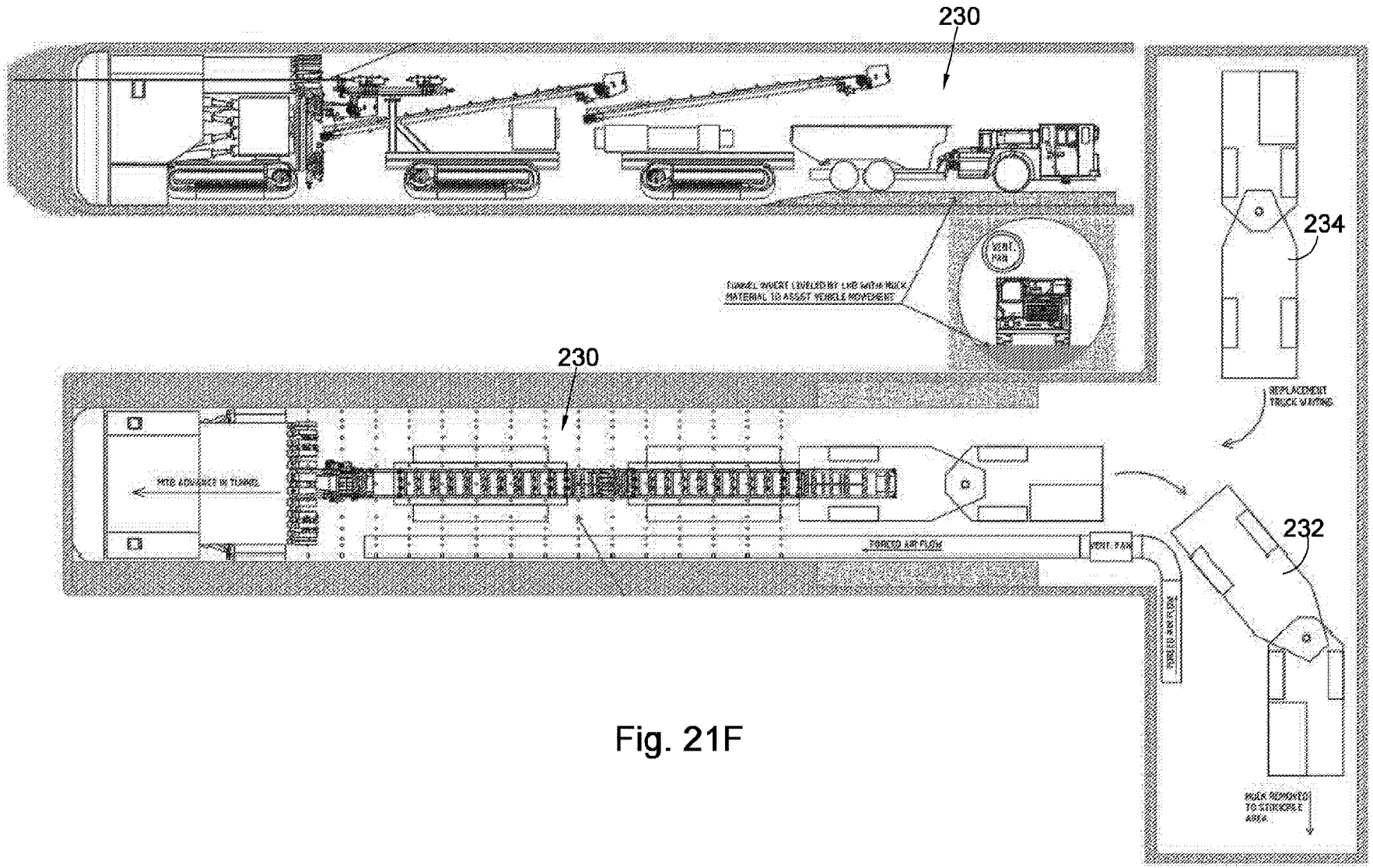
Figure 21G:
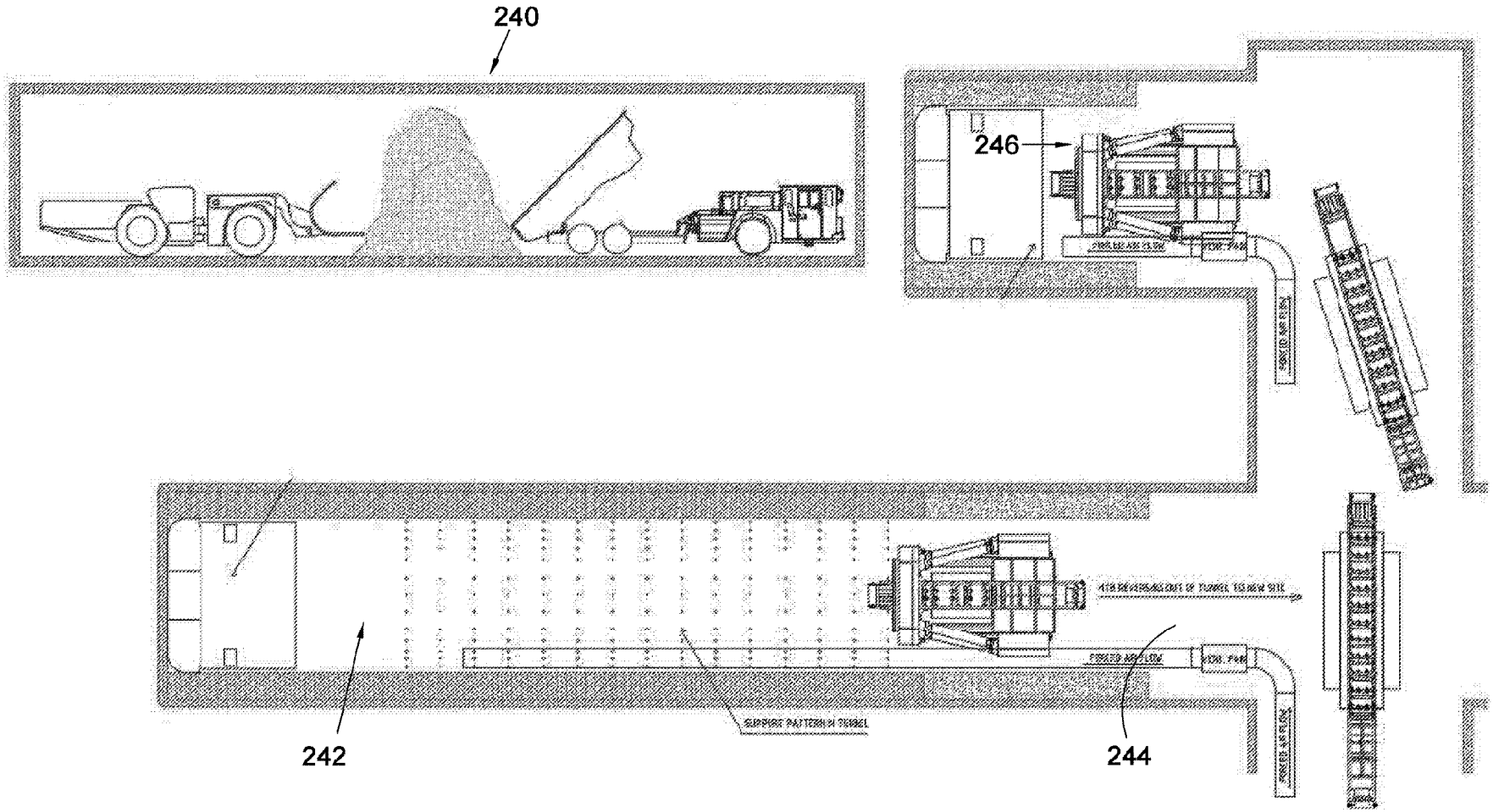

FIG. 21C shows the components of the mobile underground tunnel borer arrangement 100 of the invention being transported down a decline shaft, again provided there is at least a 2 metre passage height, as shown by arrow 220. The mobile underground tunnel borer arrangement 100 may then be assembled underground, in an adjacent chamber, as shown by arrow 222. FIG. 21D shows the mobile tunnel boring unit 102 being moved into position and ultimately connected to the cutter head 116 and front shield 130 combination, along path 226. FIG. 21E shows the first and second backup units 170, 172 being moved into position behind the mobile tunnel boring unit 102, to enable the boring cycle to commence. The boring cycle continues to enable the machine to advance, as described above, and as shown by arrow in 230 in FIG. 21F. As the muck and cuttings are conveyed rearwardly along the conveyors, muck is removed to a stockpile area by truck 232 (similar to truck 176 shown in FIG. 6A), with a replacement truck 234 (also similar to truck 176 shown in FIG. 6A) being ready to take its place so as to keep the process substantially continuous. The muck is then discharged at a stockpile area, as indicated by arrow 240 in FIG. 21G. Once the required tunnel length has been drilled, as shown by arrow 242, the mobile tunnel boring unit 102 is disconnected from the cutter head 116 and front shield 130 combination, reversed out of the tunnel as indicated by arrow 244, and then moved to a new pre-prepared site 246 in which another cutter head 116 and front shield 130 combination is waiting.

Figure 22A:
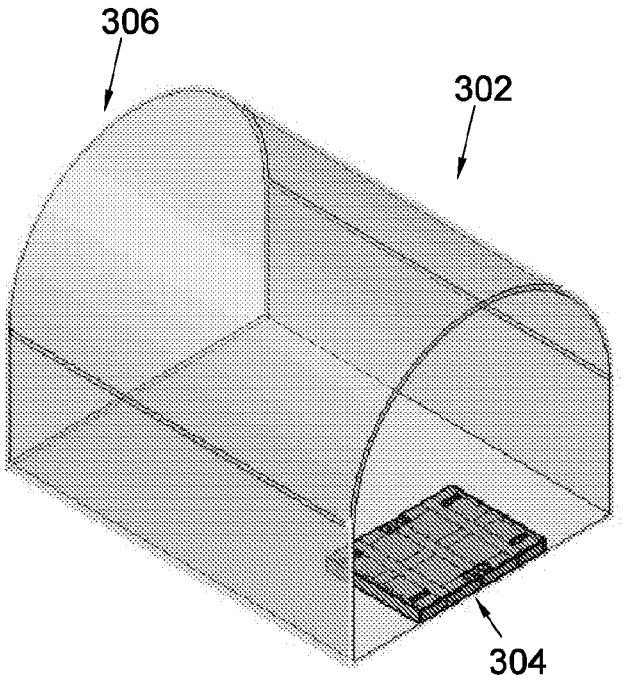
FIGS. 22A to 22W show a sequence of steps involved in the construction of a starting frame, to ultimately define the mobile tunnel boring unit shown in FIGS. 7 to 9, ready for use onsite.
Figure 22B:
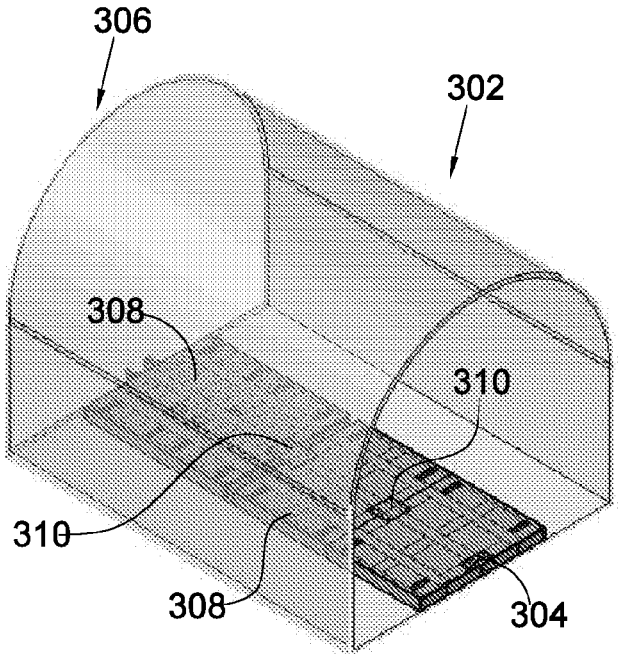
Figure 22C:
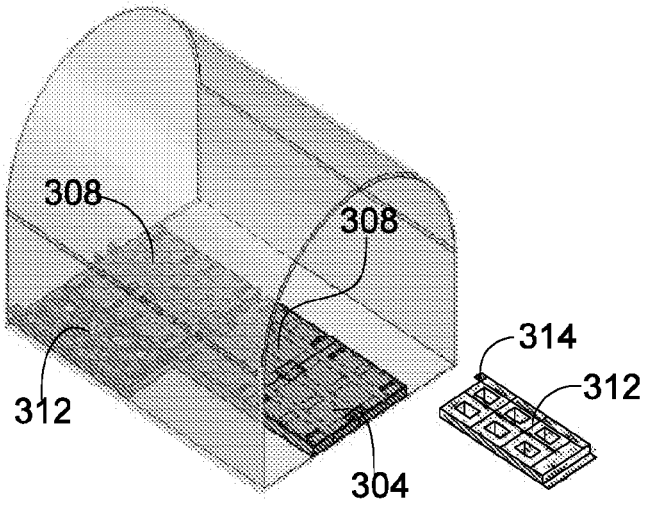
Figure 22D:
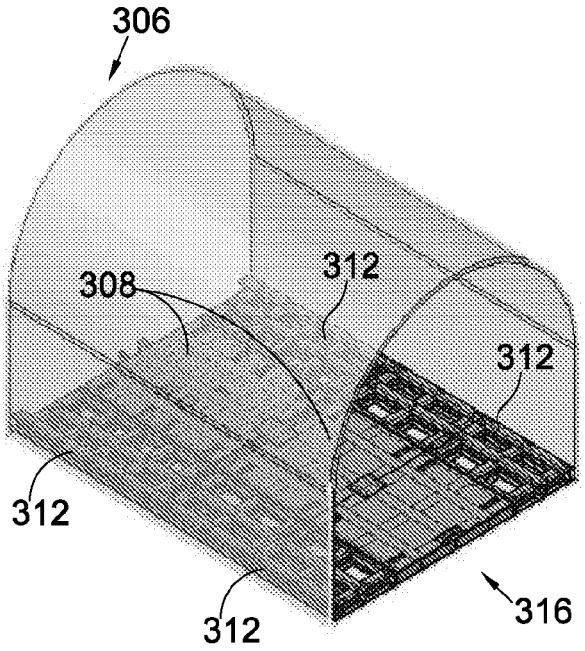
Figure 22E:
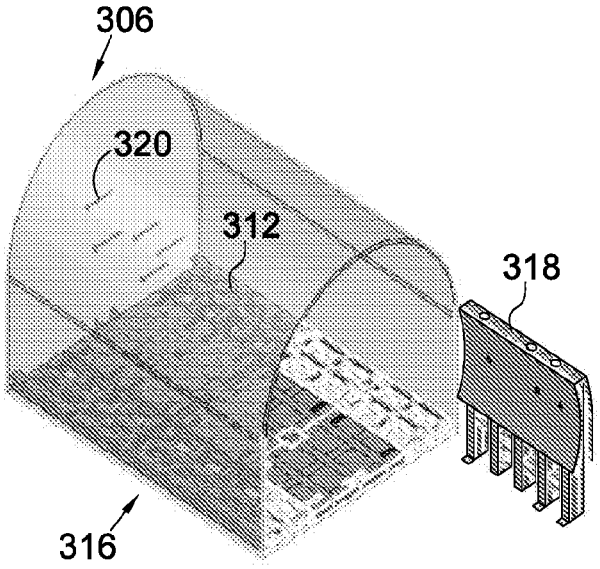
Figure 22F:
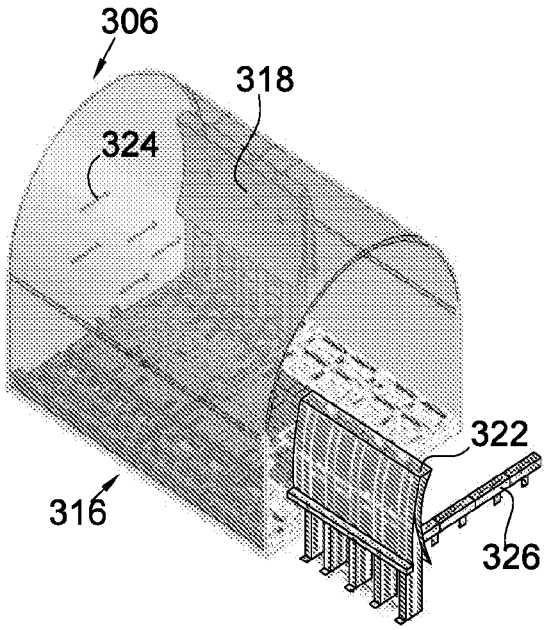
Figure 22G:
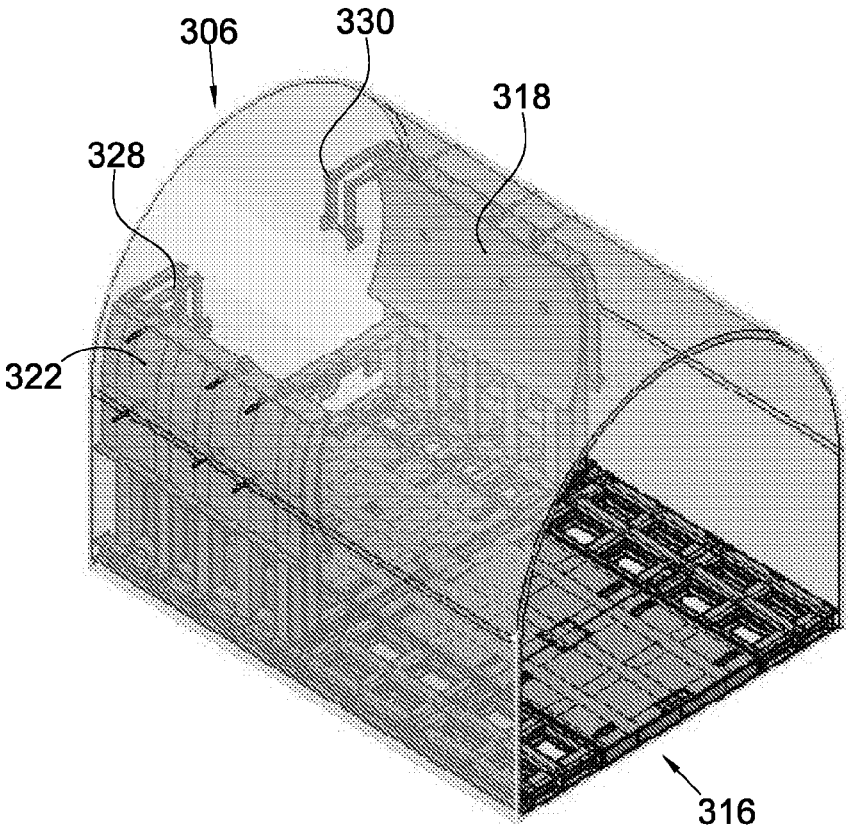
Figure 22G:
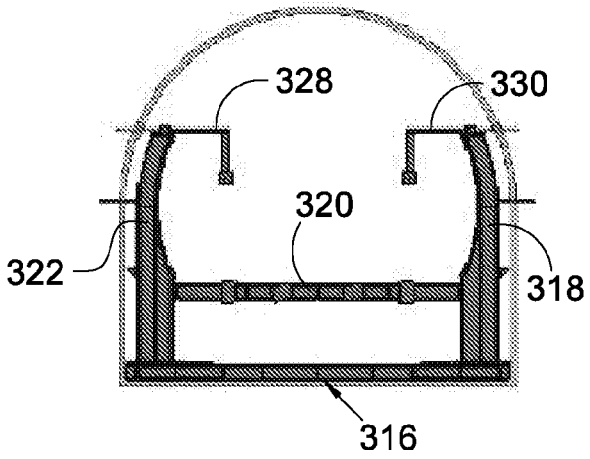
Figure 22H:
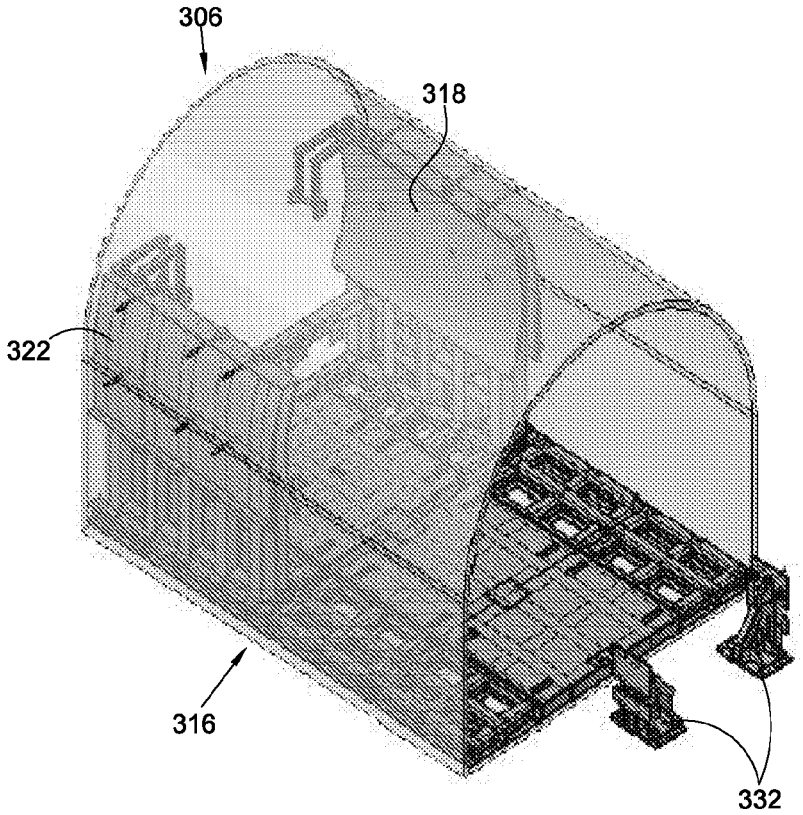
Figure 22I:
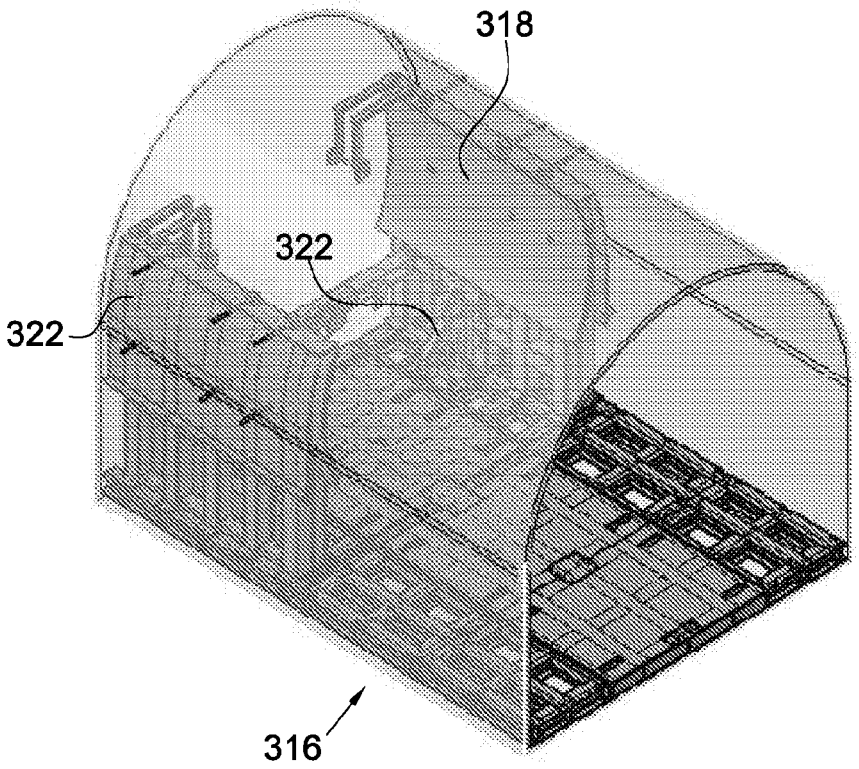
Figure 22I:
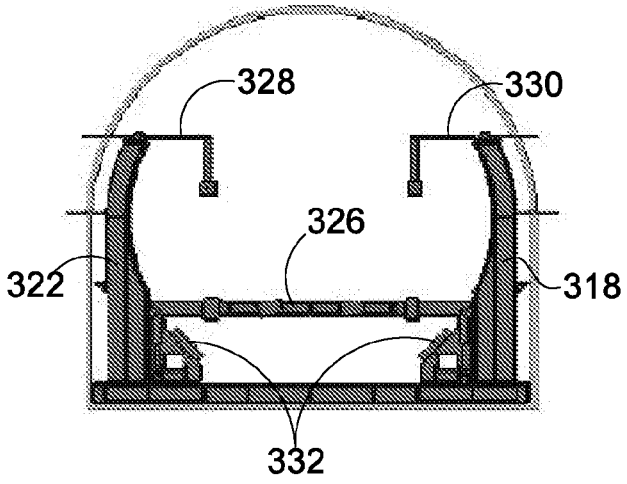
Figure 22J:
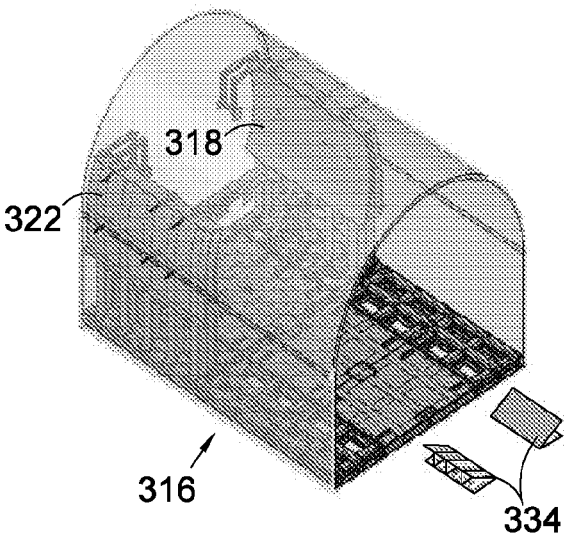
Figure 22K:
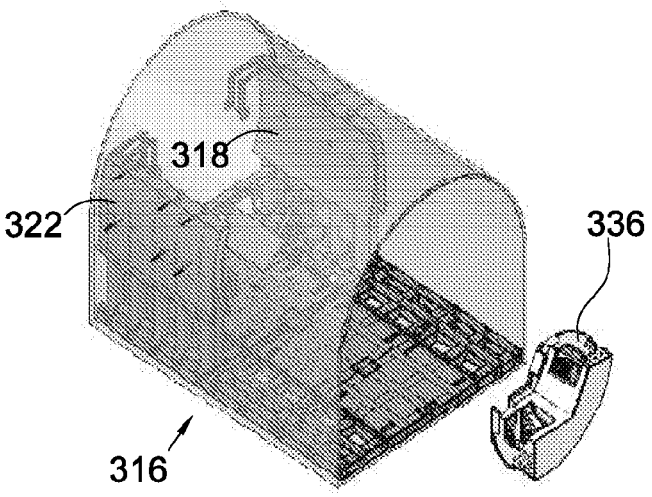
Figure 22L:
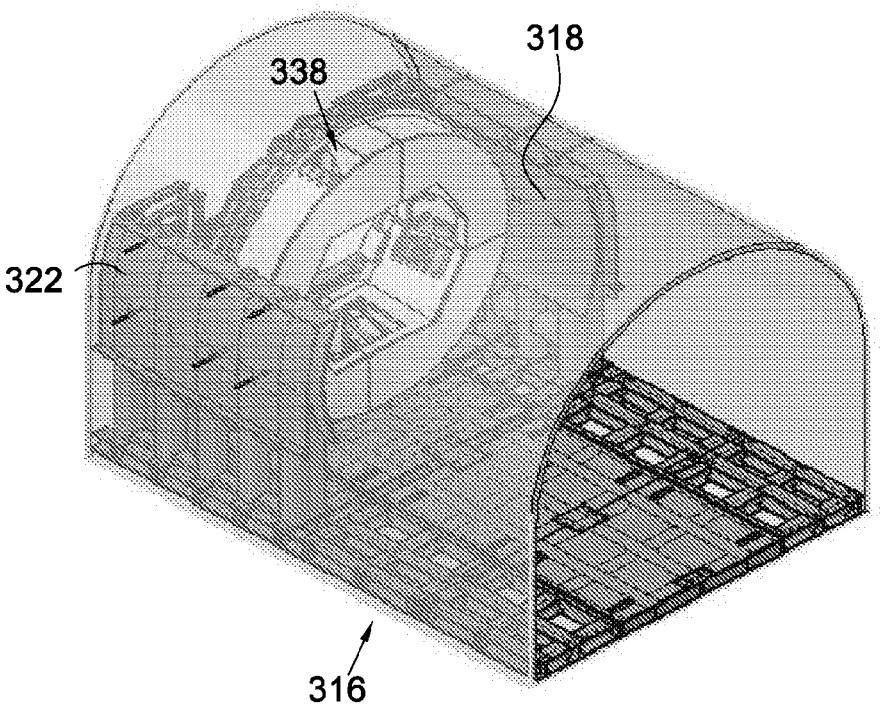
Figure 22L:
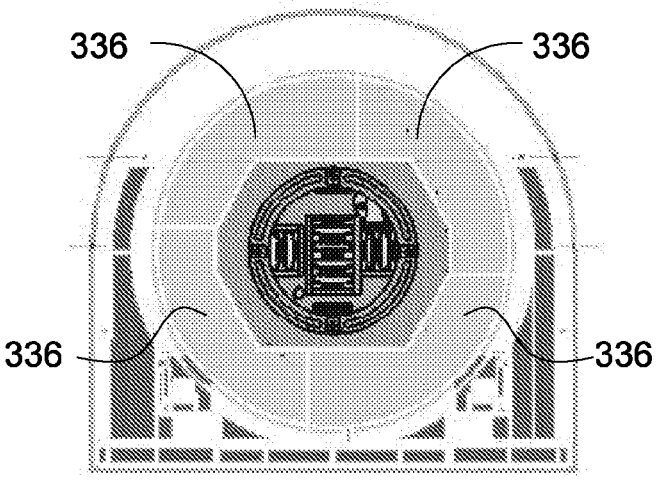
Figure 22M:
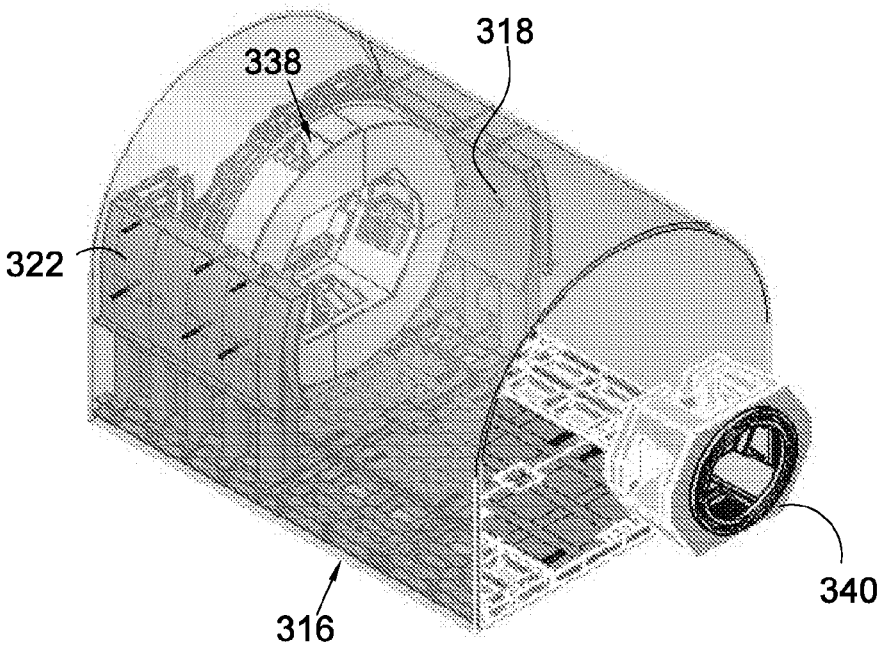
Figure 22N:
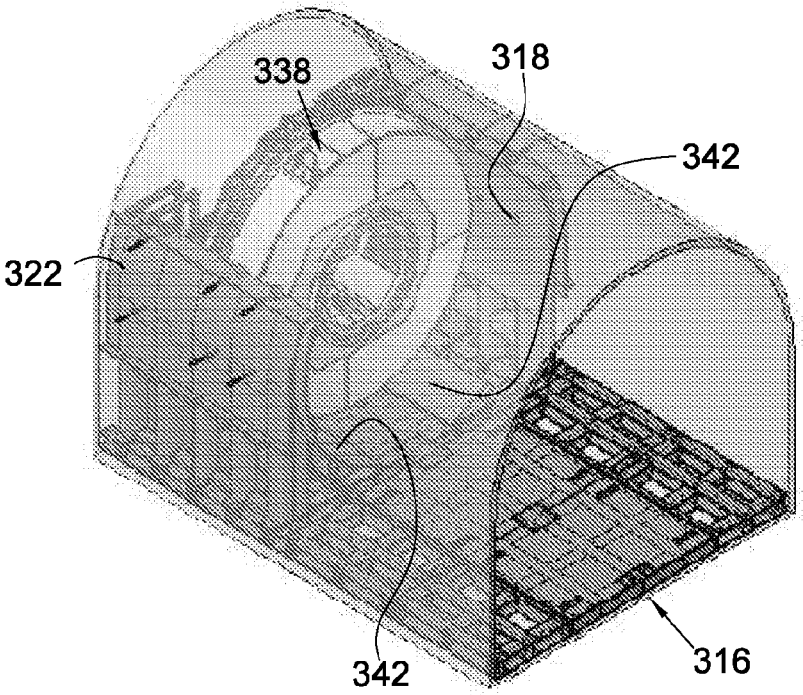
Figure 22N:
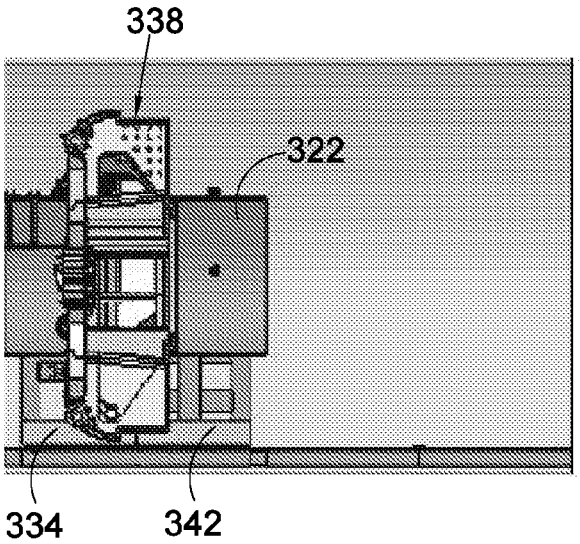
Figure 22O:
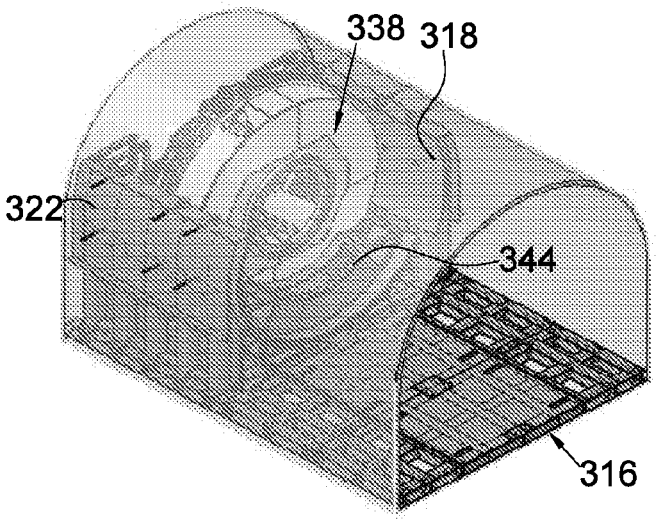
Figure 22P:
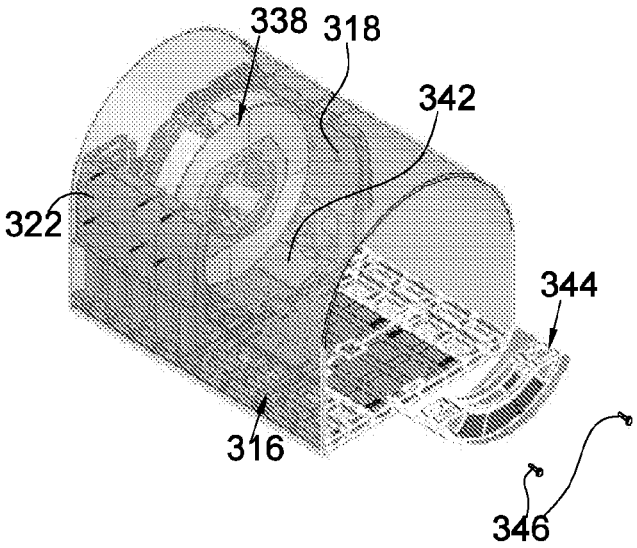
Figure 22Q:
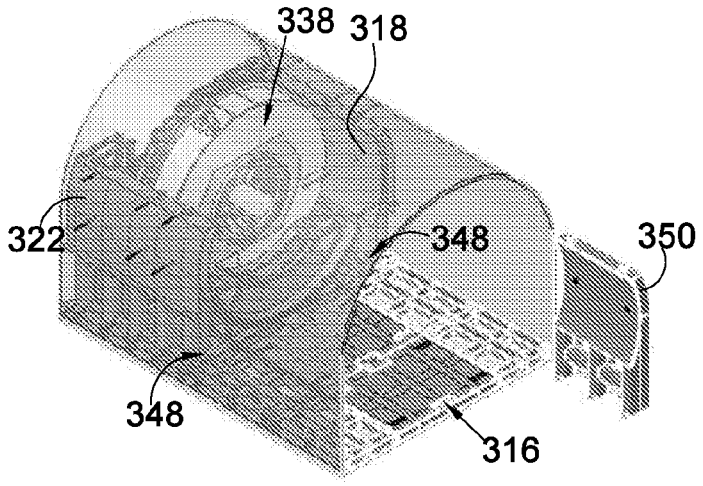
Figure 22R:
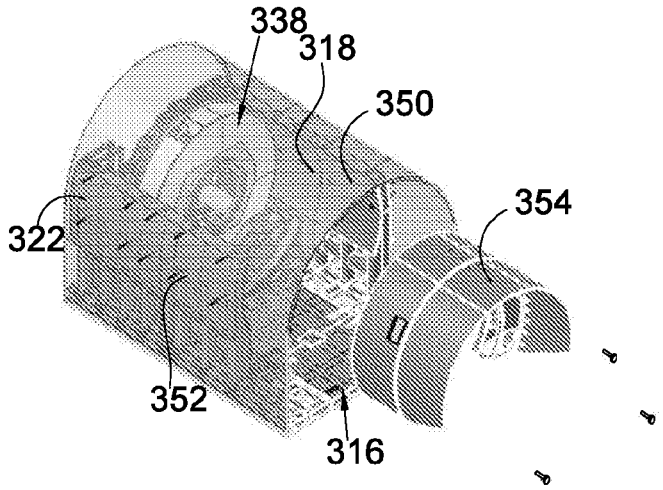
Figure 22S:
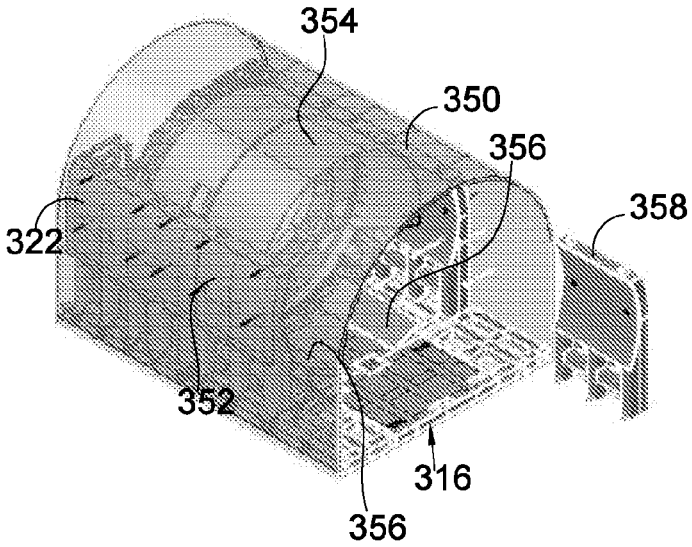
Figure 22T:
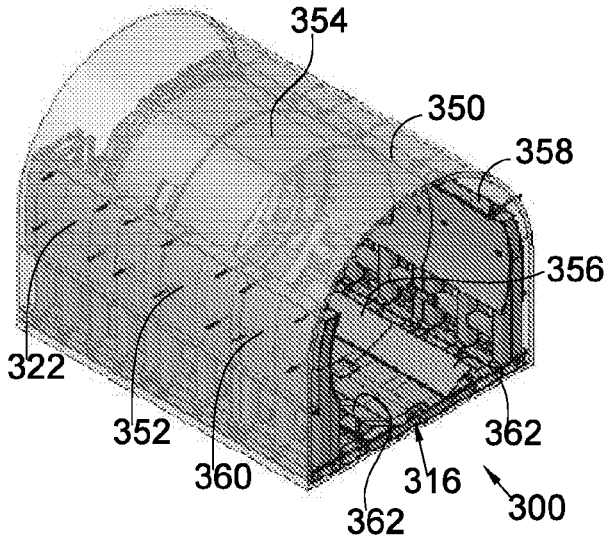
Figure 22U:
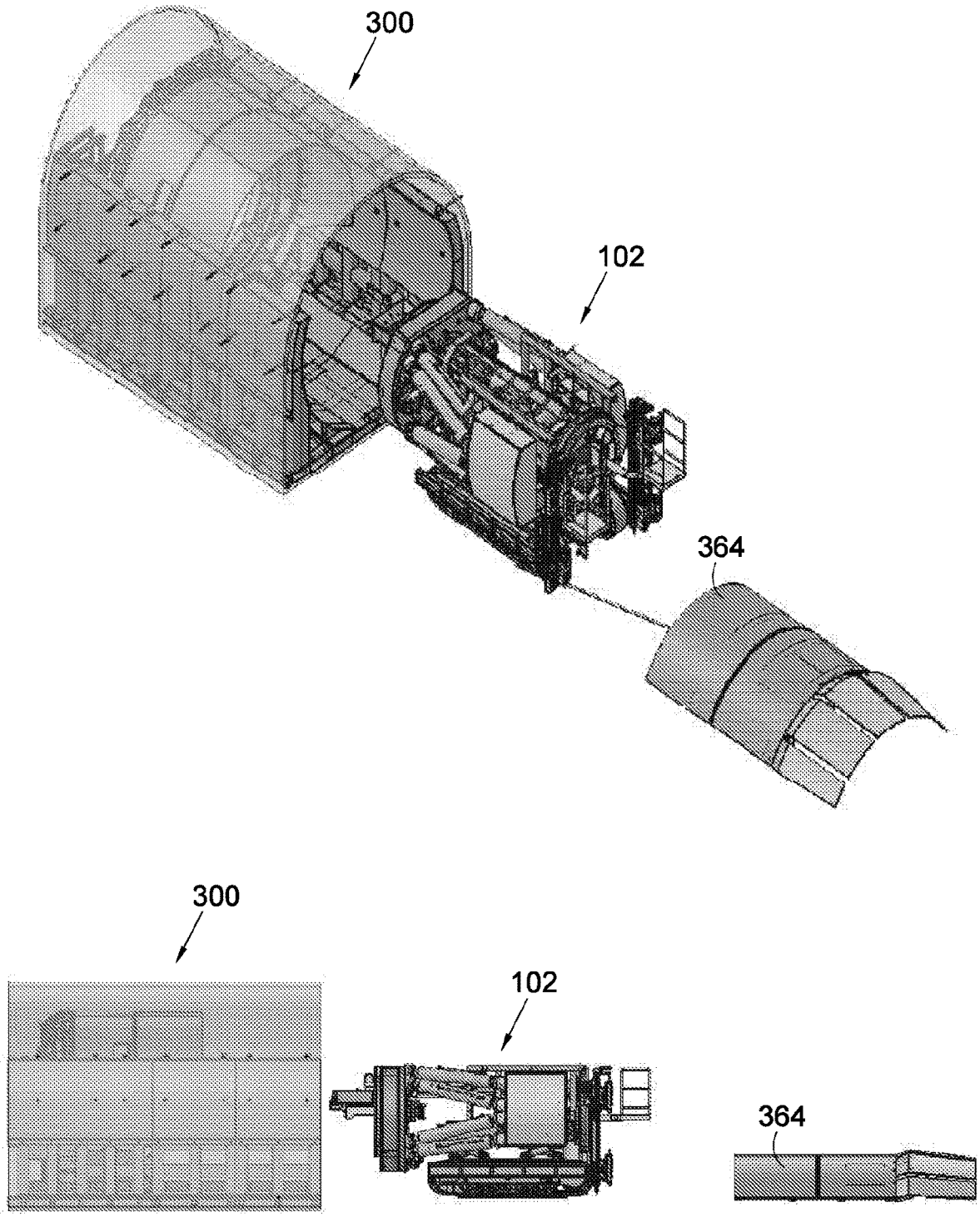
Figure 22V:
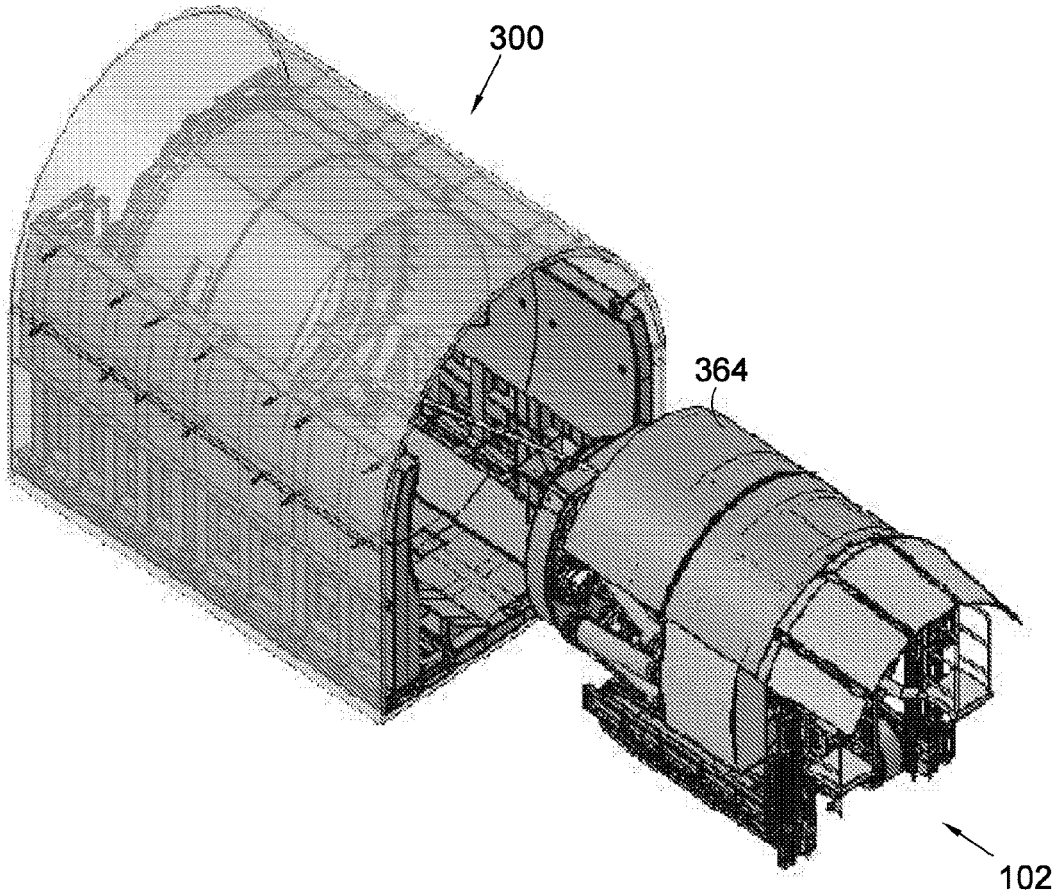
Figure 22V:
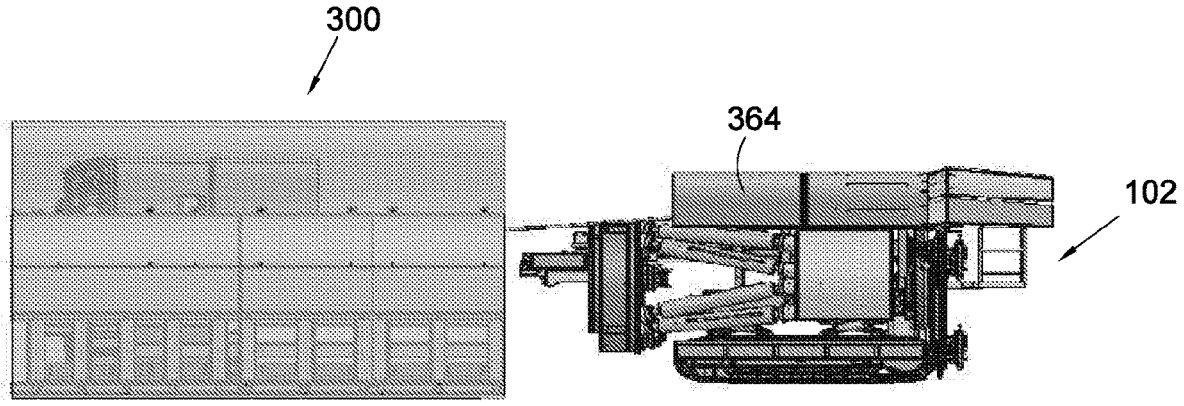
Figure 22W:
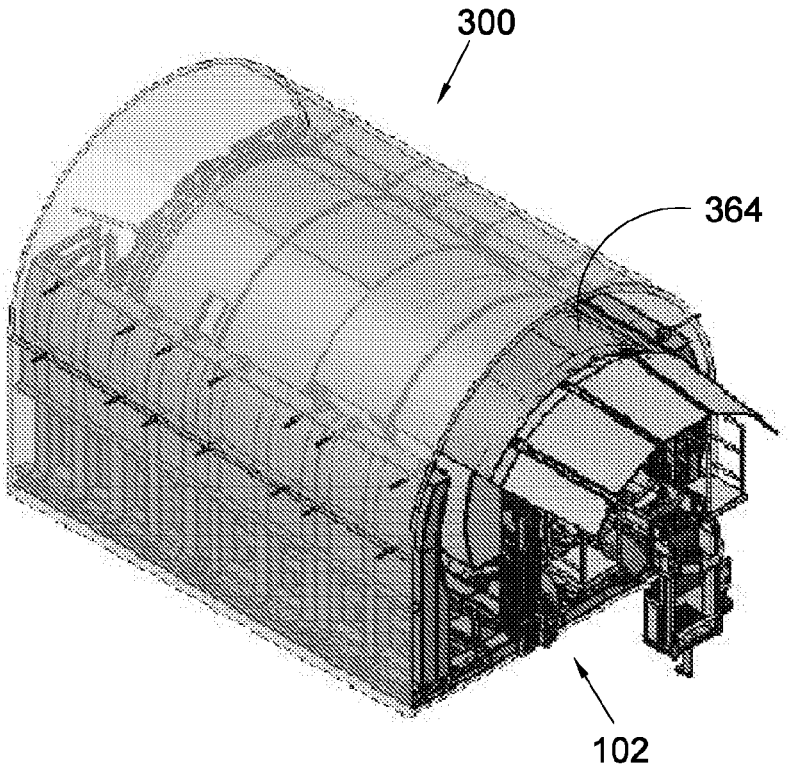

Turning now to FIGS. 22A to 22W, the construction and use of a launching or starting frame 300 (shown in FIG. 22T), within a prepared starting chamber 302, will now be described. Within the chamber 302, a first centre base frame component 304 is placed down on the ground, spaced apart from the tunnel face 306 to be drilled, as shown in FIG. 22A. Thereafter, a number of additional centre base frame components 308 are fitted to the first centre base frame component 304, typically using connection plates 310, leading up to, so as to substantially abut against, the tunnel face 306. This is shown in FIG. 22B. A number of side base frame components 312 are then fitted on either side of the assembled centre base frame components 304, 308, as shown in FIGS. 22C and 22D, again typically using connection plates 314. FIG. 22D shows the resulting assembled base 316 for the starting frame 300.

As shown in FIG. 22E, a first side frame component 318 is secured to the side base frame component 312, adjacent the tunnel face 306, using rods 320. A second side frame component 322 is secured to the opposite side base frame component 312, adjacent the tunnel face 306, using rods 324, as shown in FIG. 22F. A cutter head backstop assembly 326 is provided to extend across the first and second side frame components 318, 322. A pair of cutter head backstop telescopic pipe supports 328, 330 are fitted to upper regions of the first and second side frame components 318, 322, as shown in the views of FIG. 22G. As shown in FIGS. 22H and 22I, a pair of mobile templates 332 are provided and fitted proximate the ends of the first and second side frame components 318, 322. As shown in FIGS. 22J and 22K, a first pair of crawler track boards 334 are provided and fitted to the end of the assembled base 316. FIG. 22K also shows a first cutter head segment 336 (corresponding to peripheral cutter head segment 410 shown in FIG. 23) ready for installation.

Additional cutter head segments 336 are installed, piece by piece, to ultimately define an outer cutter head ring 338, as shown in the views of FIG. 22L. The cutter head ring is supported on the first pair of track boards 334. A central cutter head component 340 (corresponding to central cutter head segment 412 in FIG. 23) is then fitted within the cutter head ring 338, as shown in FIG. 22M (and the subsequent figures). As shown in FIG. 22N, a second pair of crawler track boards 342 are provided and fitted to the assembled base 316, adjacent the first pair of track boards 334. As shown in FIGS. 22O and 22P, a front shield sector 344 is provided and supported on top of the second pair of track boards 342. The front shield sector 344 is typically secured in position using pins 346. Turning now to FIG. 22Q, a pair of main drive cylinder components 348 are placed in position, adjacent the first and second side frame components 318, 322. This figure also show a third side frame component 350, ready to be installed adjacent the first side frame component 318.

A fourth side frame component 352 is also provided and installed, as shown in FIG. 22R. This figure also shows a front shield 354 ready to be installed, with FIG. 22S subsequently showing the front shield 354 fitted around the cutter head ring 338. FIG. 22S also shows a third pair of crawler track boards 356 provided and fitted to the assembled base 316, adjacent the second pair of track boards 342. This figure also show a fifth side frame component 358, ready to be installed adjacent the third side frame component 350. A sixth side frame component 360 is also provided and installed, as shown in FIG. 22T. This figure also shows a fourth pair of crawler track boards 362 provided and fitted to the assembled base 316, adjacent the third pair of track boards 356. The result is the now assembled starting frame 300. In use, turning now to FIG. 20U, once the starting frame 300 has been assembled, mobile tunnel boring unit 102 (in its transport configuration, as described above) is brought closer. A tail shield 364, corresponding substantially to the rear shield 132 described above, is provided and fitted on top of the boring unit 102, as shown in FIG. 20V. Finally, as shown in FIG. 20W, the mobile tunnel boring unit 102 is driven into the starting frame 300, connected to the central cutter head component 340, and is now ready to operate, as described above.

Figure 14A:
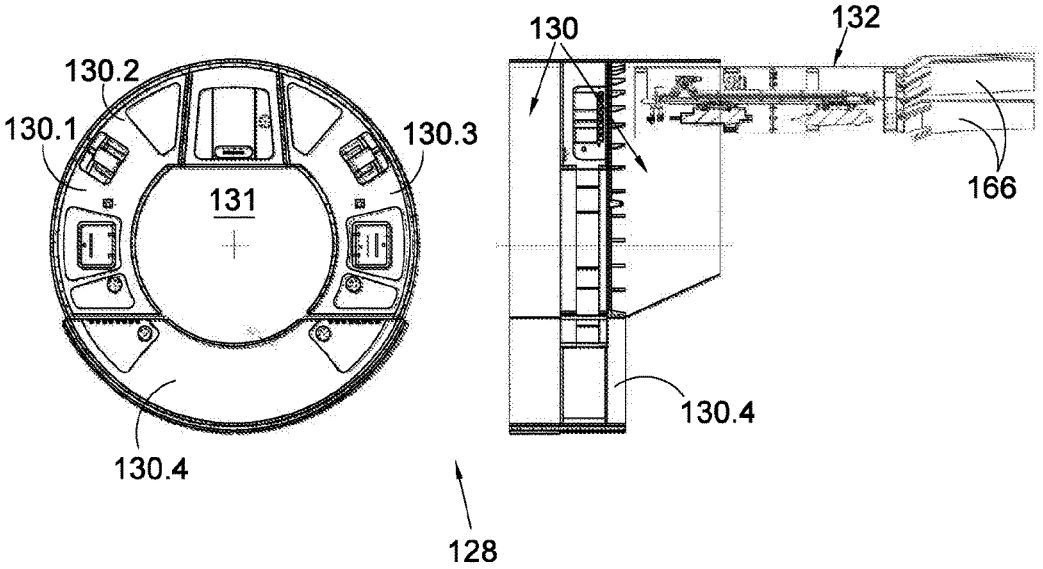
FIGS. 14A, 14B and 14C show various views of a telescopic shield arrangement used in the mobile tunnel boring unit shown in FIGS. 7 to 9.
Figure 14B:
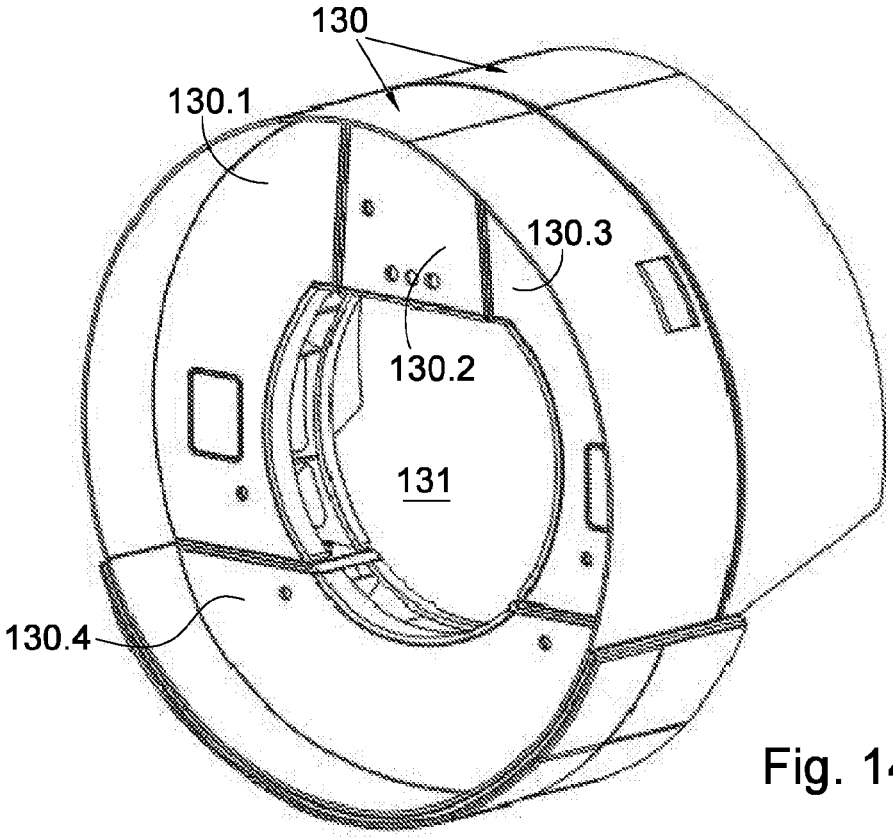
Figure 14C:
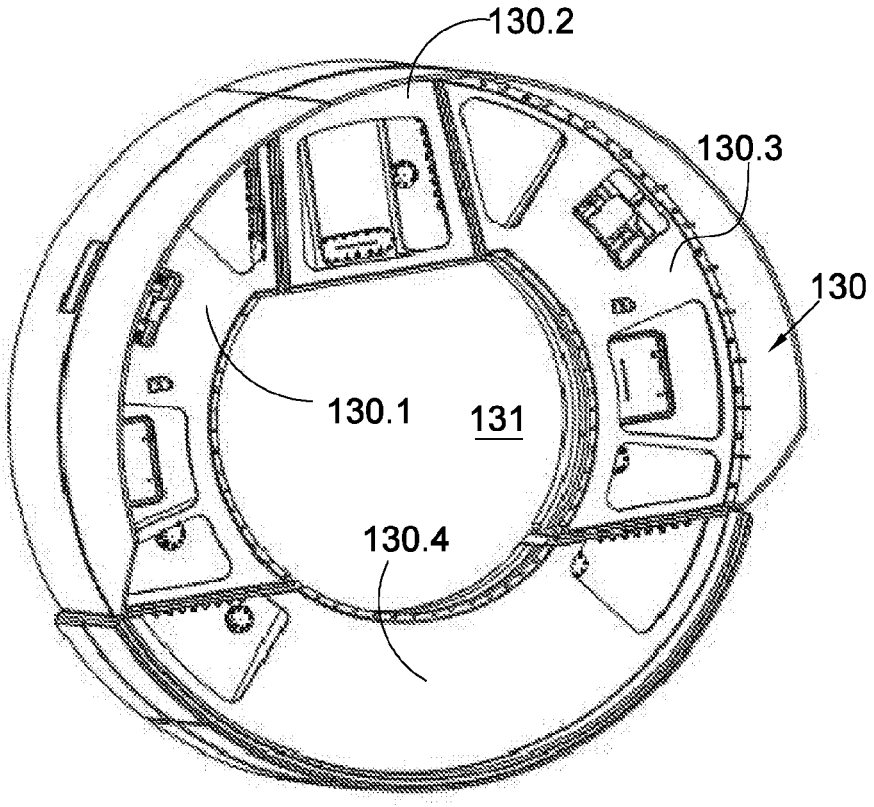
Figure 25:
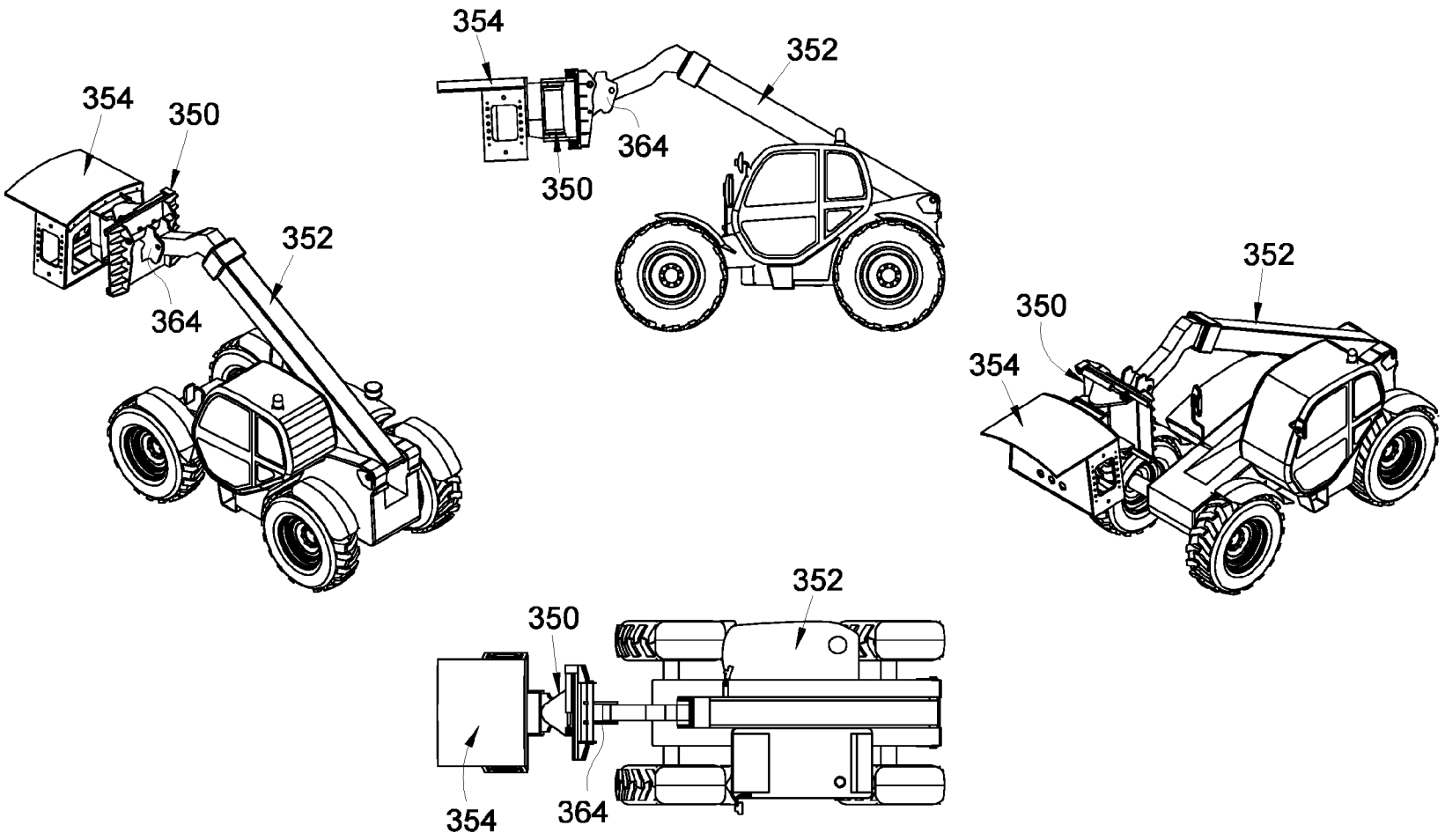
FIG. 25 shows various view of a manipulator fitted to a telehandler, for use in assembling the cutter head and shield segments inside the starting frame shown in FIGS. 22A to 22W.

To assist in the assembly of the cutter head 116 and shield segments 130.1, 130.2, 130.3 and 130.4 (as shown in FIGS. 14A, 14B and 14C) inside the starting frame 300, a manipulator 350 is provided for use by a telehandler 352, as shown in FIG. 25. The telehandler 352 is hydraulically powered and remote controlled. The manipulator 350 is arranged to pick up a component 354 corresponding to any of the cutter head and/or shield segments, drive the component 354 into the starting frame 300, and place it where required to facilitate the assembly or connection of the relevant component 354.

Figure 26:
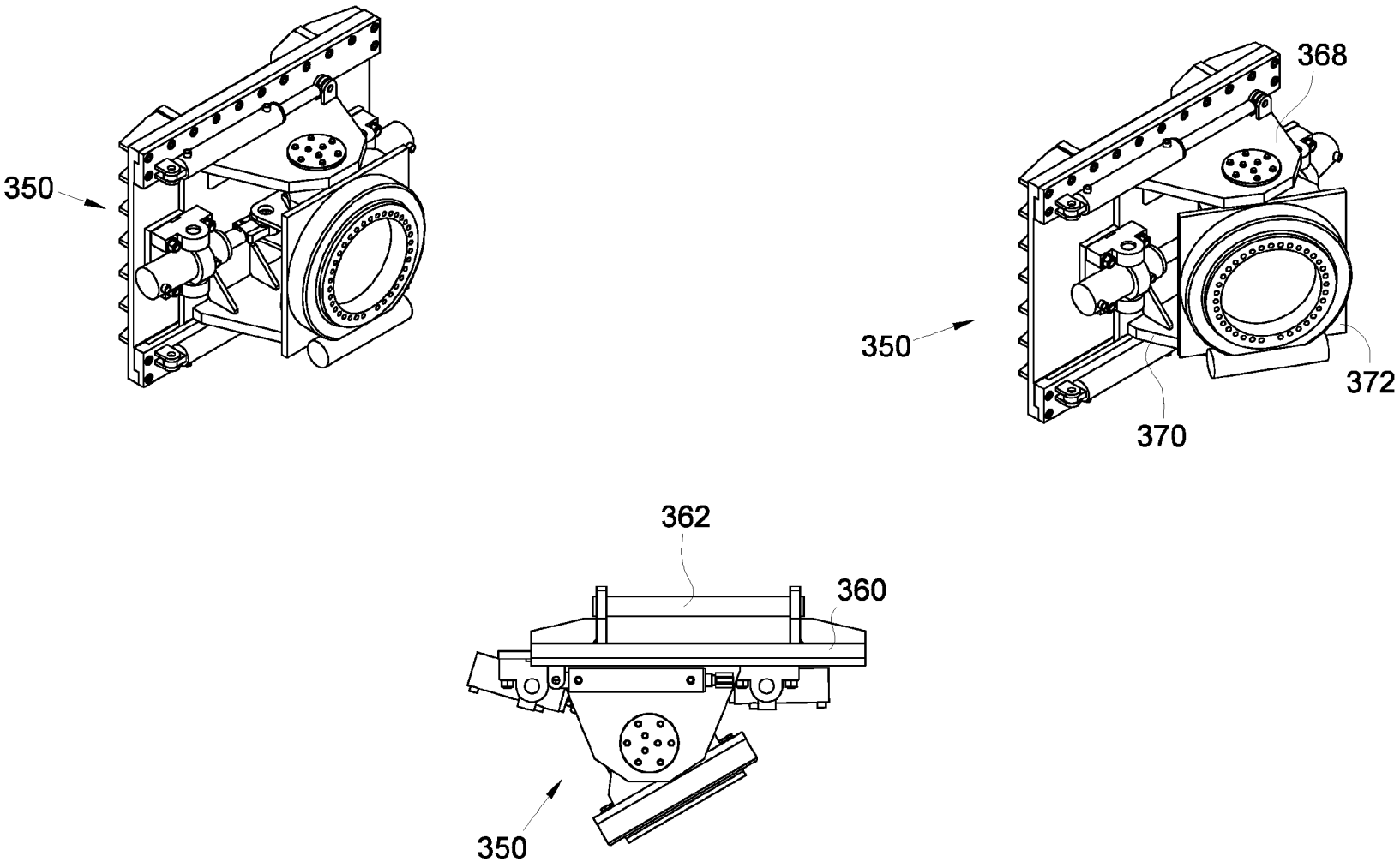
FIG. 26 shows various view of the manipulator shown in FIG. 25.

The manipulator 350 is shown in more detail in FIG. 26, and typically comprises a rear plate 360 having an elongate support 362 that can be grabbed and lifted by a hooking arrangement 364 at the end of the telehandler 352. A support arrangement extends from the front of the rear plate 360, comprising a pair of spaced support plates 368, 370. A securing plate 372 is fitted across the ends of the support plates 368, 370, the securing plate 372 being pivotable relative to the support plates 368, 370, to enable the relevant component 354 to be placed where required.

The tunnel borer arrangements of the present invention is far more mobile and versatile than traditional TBMs of the type described above, and is relatively cheaper. In addition, the use of various interchangeable components greatly simplifies maintenance, thereby increasing overall efficiency of the machine.

In addition, the present invention overcomes the need for drilling and blasting, with the inherent strength provided by the round shape of the bored tunnel being particularly advantageous underground.

The invention claimed is:

1. A mobile tunnel boring unit comprising:

a support body driven by first drive means, the first drive means for driving the mobile tunnel boring unit including a pair of spaced apart crawler tracks in contact with the tunnel floor and related track driving means to move the tracks, and thus the support body;

cutter head drive means located at an operatively front end of the support body which can be fitted to a rotatable cutter head that has been pre-installed in a starting chamber, proximate a tunnel face to be bored, so as to rotatingly drive the rotatable cutter head, in use;

a muck hopper and a first conveyor arrangement extending from an operatively front end of the cutter head drive means, the cutter head comprising a full face cutter head fitted with cutters to bore a tunnel face, the cutter head being arranged to allow cuttings to pass through the cutter head for discharge into the muck hopper and onto the first conveyor arrangement, the cutter head drive means and a rear portion of the cutter head defining aligned central apertures through which a front part of the first conveyor arrangement can extend;

a telescopic shield arrangement to shield the boring unit, the shield arrangement comprising a front shield proximate the front of the mobile tunnel boring unit, from which the cutter head protrudes and for accommodating the cutter head drive means, the front shield also having been pre-installed in the starting, chamber together with the cutter head, and a rear shield that surrounds at least an upper portion of the mobile tunnel boring unit, the front and rear shields operating telescopically relative to each other, to accommodate changes in the boring direction; and an actuating arrangement comprising a plurality of hydraulic thrust cylinders extending between the cutter head drive means and a pair of opposite first gripper assemblies.

2. The mobile tunnel boring unit of claim 1, wherein the first drive means includes a cross support that extends between the pair of spaced apart crawler tracks, the tracks being pivotally mounted to the cross support to enable the tracks to rotate relative to the cross support so as to conform with the round shape of a bored tunnel.

3. The mobile tunnel boring unit of claim 2, wherein the mobile tunnel boring unit further includes a lifting arrangement that extends between the support body and the first drive means so as to lift the support body and in turn the cutter head drive means relative to the tracks to enable the support body and the cutter head drive means to be lifted relative to the first drive means to the required height to enable the cutter head drive means to be fitted to the pre-installed rotatable cutter head within the starting chamber.

4. The mobile tunnel boring unit of claim 1, wherein the cutter head comprises a plurality of peripheral cutter segments and a central cutter head segment, wherein the central cutter head segment has tapered side walls and the corresponding inner faces of the peripheral cutter segments being tapered accordingly to ensure a tight fit, with the central cutter head segment in turn being connectable the cutter head drive means, wherein the size of the peripheral cutter segments are variable, depending on the size of the tunnel to be bored, while the central cutter head segment remains the same irrespective of the tunnel size to be bored.

5. The mobile tunnel boring unit of claim 1, wherein the first conveyor arrangement extends through the middle of the mobile tunnel boring unit for subsequent offloading onto a first backup unit, the first conveyor arrangement comprising a front conveyor section and a rear conveyor section, with the front conveyor section being retractable away from the cutter head drive means, out from under the muck hopper, to allow access to the cutter head.

6. The mobile tunnel boring unit of claim 1, wherein the front shield comprises a plurality of peripheral segments joined together, to provide a fully supported shield proximate the tunnel face, the peripheral segments defining a central aperture to accommodate the cutter head drive means and through which a front part of the first conveyor arrangement and the muck hopper can extend, with one of the segments comprising a belly shield segment to stabilise the mobile tunnel boring unit by skidding along e-n-the tunnel invert.

7. The mobile tunnel boring unit of claim 6, wherein the front shield is secured to the outside of the cutter head drive means and the rear shield is secured to a rear end of the mobile tunnel boring unit, to enable the actuating arrangement to telescopingly move the front shield relative to the mobile tunnel boring unit and the rear shield.

8. The mobile tunnel boring unit of claim 1, wherein the thrust cylinders comprises four pairs of thrust cylinders, two pairs on either lateral side of the unit, that extend inwardly from the first gripper assemblies towards the cutter head drive means, to enable the mobile tunnel boring unit to be steered in all directions, with the ends of the thrust cylinders being fitted with spherical ball joints to provide a flexible link between the cutter head drive means and the rest of the mobile tunnel boring unit.

9. The mobile tunnel boring unit of claim 1, wherein the mobile tunnel boring unit includes a gripper arrangement to facilitate boring by providing the required gripping and thrusting, the gripper arrangement including a pair of front, relatively smaller, second gripper assemblies, arranged to protrude from the front shield, with the first gripper assemblies comprising a pair of rear, relatively larger first gripper assemblies fitted to, so as to extend from, the support body.

10. The mobile tunnel boring unit of claim 9, wherein the second gripper assemblies define a V so as to extend radially upwardly, on either side of an upper edge of the front shield, and the first gripper assemblies extend on opposite sides of the mobile tunnel boring unit, with cylinder barrels being carried on the support body for guiding the movement of the first gripper assemblies, with the first gripper assemblies including movable, curved gripper elements.

11. The mobile tunnel boring unit of claim 9, wherein under the control of the thrust cylinders the first gripper assemblies can be extended and retracted, relative to the mobile tunnel boring unit, with the gripper elements, in the extended position, gripping against the tunnel wall, and in the retracted position, the mobile tunnel boring unit being free to move forwards while the second gripper assemblies extend to grip the tunnel wall, with the actuating arrangement then being used to pull the rear of the mobile tunnel boring unit forwards.

12. The mobile tunnel boring unit of claim 1, wherein the mobile tunnel boring unit further includes a support drill rotation ring fitted proximate the rear end of the mobile tunnel boring unit, and associated ring drive means to rotate the ring, the support drill rotation ring carrying at least two spaced apart support drills to facilitate the fitting of rock bolt supports to the surrounding wall, and which can operate simultaneously, with the ring and support drills defining an on-board rock support bolting system that can provide support while the mobile tunnel boring unit is busy excavating.

13. The mobile tunnel boring unit of claim 12, wherein the rear shield includes a plurality of fingers that define gaps through which the support drills can extend and drill, the fingers guiding and assisting in the drilling operation of the support drill, with the mobile tunnel boring unit further including at least probe drill, safely housed within the rear shield, to allow drilling in advance to locate bad ground conditions and/or water ahead of the boring unit.

14. A mobile underground tunnel borer arrangement comprising:

a mobile tunnel boring unit according to claim 1; and at least one rear, trailing backup unit arranged behind the mobile tunnel boring unit, in use.

15. The mobile underground tunnel borer arrangement of claim 13, wherein a first backup unit is fitted with a second conveyor arrangement to transport the cuttings and muck from the first conveyor arrangement on the mobile tunnel boring unit towards a second backup unit, the second backup unit being fitted with a third conveyor arrangement to receive the cuttings and muck from the second conveyor arrangement on the first backup unit towards a truck or bunker car.

16. The mobile underground tunnel borer arrangement of claim 15, wherein the first, second and third conveyor arrangements are all collapsible, to improve manoeuvrability, wherein the end portions of the conveyor arrangements can be folded or pivoted downwardly.

17. A method of boring a tunnel, the method comprising:

constructing a starting frame within a starting chamber, comprising assembling a plurality of base frame components on the ground within the chamber to define a base frame leading up towards a tunnel face to be bored;

fitting a pair of side frame components on either side of the base frame, adjacent the tunnel face;

assembling a plurality of peripheral cutter head segments at the end of the chamber, substantially adjacent the tunnel face to be bored, to ultimately define an outer cutter head ring;

fitting a central cutter head segment in the centre of the cutter head ring, to define a cutter head;

fitting a belly front shield segment, on the floor adjacent the cutter head;

assembling a plurality of front shield segments over the cutter head, and securing these segments to the belly front shield segment, to define a front shield;

fitting a rear shield on top of a mobile tunnel boring unit according to claim 1; and connecting the mobile tunnel boring unit to the cutter head and the front shield.

18. The method of claim 17, wherein additional side frame components are fitted as the assembly progresses.

19. The method of claim 17, wherein a manipulator is provided for use by a telehandler to assist in the assembly of the cutter head segments and the shield segments inside the starting frame, the manipulator comprising a rear plate having an elongate support that can be grabbed and lifted by a hooking arrangement.

* * * * *